US008654987B2

(12) United States Patent
Palma

(10) Patent No.: US 8,654,987 B2
(45) Date of Patent: Feb. 18, 2014

(54) AUDIO PLAYER HEADSET EARHOOK APPARATUS AND SYSTEM THEREOF

(76) Inventor: Dennis Palma, Monterey, CA (US)

( * ) Notice: Subject to any disclaimer, the term of this patent is extended or adjusted under 35 U.S.C. 154(b) by 610 days.

(21) Appl. No.: 12/987,998

(22) Filed: Jan. 10, 2011

(65) Prior Publication Data

US 2011/0170703 A1 Jul. 14, 2011

Related U.S. Application Data

(60) Provisional application No. 61/294,093, filed on Jan. 11, 2010.

(51) Int. Cl.
*H04R 1/10* (2006.01)

(52) U.S. Cl.
USPC ..... 381/74; 381/370; 381/381

(58) Field of Classification Search
USPC ..... 381/74, 309, 77, 80, 85, 123, 381, 81, 381/380, 371, 374, 376, 379
See application file for complete search history.

(56) References Cited

U.S. PATENT DOCUMENTS

| | | | | |
|---|---|---|---|---|
| 7,072,476 | B2 * | 7/2006 | White et al. | 381/74 |
| 7,146,199 | B2 | 12/2006 | Bush | |
| 7,206,429 | B1 | 4/2007 | Vossler | |
| 7,251,335 | B1 | 7/2007 | Chen | |
| 7,254,368 | B1 | 8/2007 | Okada et al. | |
| 7,356,362 | B2 | 4/2008 | Chang et al. | |
| 7,409,064 | B2 | 8/2008 | Watanuki | |
| 7,986,803 | B1 * | 7/2011 | DeKalb | 381/380 |
| 2002/0003889 | A1 | 1/2002 | Fischer | |
| 2005/0069146 | A1 | 3/2005 | Bum | |
| 2006/0088171 | A1 | 4/2006 | Yeh | |
| 2007/0015537 | A1 * | 1/2007 | DeBiasio et al. | 455/556.1 |
| 2007/0053544 | A1 | 3/2007 | Jhao et al. | |
| 2007/0058819 | A1 | 3/2007 | Hertz et al. | |
| 2007/0067054 | A1 | 3/2007 | Danish | |
| 2007/0154047 | A1 | 7/2007 | Coyne | |
| 2007/0154048 | A1 * | 7/2007 | Chang | 381/371 |
| 2007/0223719 | A1 | 9/2007 | Huang | |
| 2008/0023508 | A1 * | 1/2008 | Harchol | 224/183 |
| 2008/0049961 | A1 | 2/2008 | Brindisi | |
| 2008/0107301 | A1 | 5/2008 | Kim et al. | |
| 2008/0166002 | A1 | 7/2008 | Amsel | |
| 2008/0253603 | A1 | 10/2008 | Huang | |
| 2008/0298606 | A1 | 12/2008 | Johnson et al. | |
| 2009/0067658 | A1 | 3/2009 | Lin | |
| 2010/0045928 | A1 * | 2/2010 | Levy | 351/158 |
| 2010/0226509 | A1 * | 9/2010 | Filson et al. | 381/105 |
| 2010/0324705 | A1 * | 12/2010 | Vandiver | 700/94 |

* cited by examiner

*Primary Examiner* — Vivian Chin
*Assistant Examiner* — Friedrich W Fahnert
(74) *Attorney, Agent, or Firm* — Intellectual Property Law Group LLP

(57) ABSTRACT

A standalone, earhook style headset interface and control apparatus that plugs into and engages a micro audio player, particularly, a micro MP3 player, used as an integral part of an ear supported, recorded audio device player or headphone. The earhook headphone system combines player controls, speaker and speaker controls, and headphone jack to plug in a second headphone for stereo listening of programmed audio while securing the MP3 player on, behind or about the ear during vigorous activity. An auxiliary jack also functions as the programming and recharging interface for the audio player device. A selector control switch for single/duplex single ear channel listening is located on the housing. A spring tail earhook of flexible soft silicone material, functions as the gripping and stabilizing element of the earhook headset, securing the unit behind or near the ear. All control functions of the audio player are integrated into the earhook headset.

20 Claims, 32 Drawing Sheets

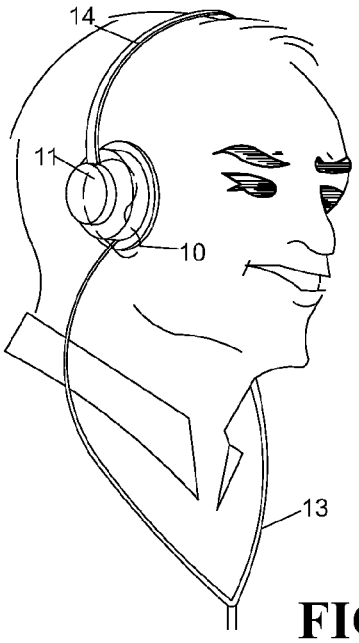
FIG. 1A
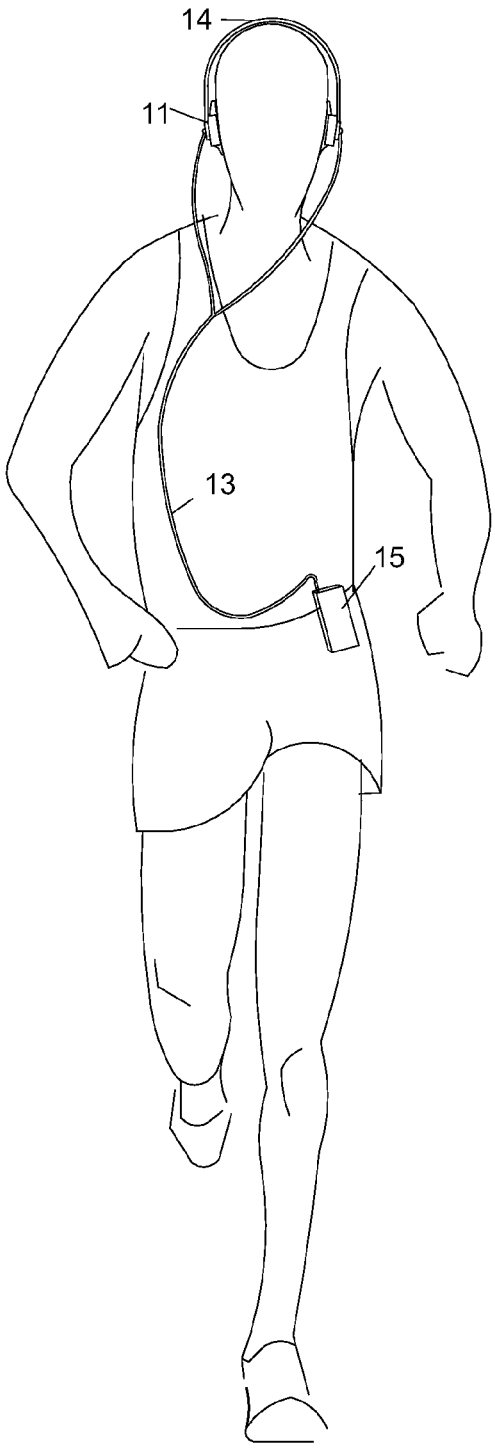
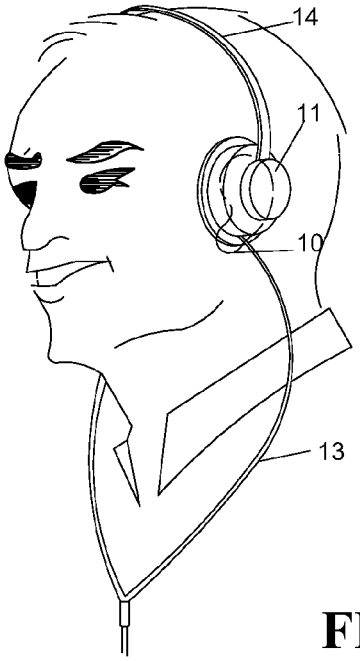
FIG. 1B
FIG. 1
Prior Art

AUDIO PLAYER HEADSET EARHOOK APPARATUS AND SYSTEM THEREOF

CROSS-REFERENCE TO RELATED APPLICATION

This application claims priority under 35 U.S.C. §119(e) to U.S. Provisional patent application No. 61/294,093, filed on Jan. 11, 2010, which is hereby incorporated by reference for all purposes.

FIELD OF THE INVENTION

The present invention relates to a digital audio player headset interface and, more particularly, to a stand alone, ear hook style headset interface and control apparatus that plugs into and enables a micro MP3 player to be used as an integral part of an ear supported, recorded audio device player or headphone.

BACKGROUND

Recently, the market of digital music players has been rapidly expanding. Well-known manufacturers such as Apple® have developed various new MP3 products with the newest music management software to satisfy consumers' needs of smaller, high performance, high capacity and lower cost devices.

Today there is widespread popularity and use of handheld devices such as MP3 audio players that have a major function of delivering programmed audio signal from an external audio source to the ears of a user via a cable and headphones. There is gaining popularity of single function, high storage capacity, displayless devices that are micro in size in contrast to the more common hand held devices that perform similar functions of audio playback. These micro MP3 players are lightweight, clip to clothing and interface to standard audio headsets.

For the purpose of maintaining and increasing their market share in the growing market of digital music players the so-called iPod Shuffle®, the newest digital music player manufactured by Apple®, is provided with a storage medium of a flash memory instead of a miniature hard disk used in the previous "iPod" digital music player. As a result, the thickness of the iPod Shuffle player is only 5 mm, and the weight thereof is only 16 g, so as to carry out the design purpose of miniaturization.

A traditional audio headset is a "passive" device that requires an audio source such as a radio, CD/tape player, MP3 or "iPod" music player. Until now, the headset and the external audio source have traditionally been separate devices, connected by long cables and worn about the body and the head.

During the use of handheld audio devices, the user must hold the device in one hand, visually sight the display and access the controls with the other hand usually during some form of activity. This is also generally performed with both headphones in place about the user's ears and isolating the user from hearing environmental sounds or other people speaking.

When listening to audio from an audio player, using a conventional headphone or player system, the user is inhibited from monitoring the sounds in the immediate surrounding environment such as parking lots, traffic cross walks, crowded venues and the like. In the listening of audio files and background music, a user would be capable of receiving full benefit of an audio player while listening through one ear, leaving the other ear free to monitor the environmental background sounds, if an improved audio player device were to exist.

Persons that are engaged in various activities, such as walking, exercising, biking, working at a desk, relaxing or the like, enjoy listening to pre-recorded audio material through headphones. The headphones are physically attached to the audio device via wires that are used to channel the audio output from the audio device to the stereo speakers in the headset. The existence of the physical connection (i.e., wires) between the headphones and the audio device can be burdensome, annoying and potentially dangerous.

Most headsets require one or more cables for connecting to the external audio source and/or for connecting the earpieces. Headset cables are usually of some fixed length and they are quite often either too long or too short. Most people use some kind of cable tie to wrap the cable into a bundle so as to control their length. This cable management makes the use of a headset quite troublesome during physical activity, storing away and untangling to reuse.

Wires or cords can become tangled or can catch on an object and thereby interfere with the use and enjoyment of such devices. Wires can be clumsy and inconvenient and being tethered to wires can produce an entanglement in a critical maneuver or motion particularly when engaged in physical activities.

Many users of small audio devices use special carriers or accessory holders such as a hip, waist or arm belts that are designed to support the device more easily by the user during operation. But placing the audio device in the accessory (such as a pocket or holder) often makes it difficult to operate the controls on the audio device, such as the on/off, channel change and/or volume controls. In addition, such carriers or holders can feel uncomfortable when attached to the body and further inhibit movement at times or limit the type of clothing worn by the user.

Further improvements are still needed that will make audio players more convenient in operation as well as enhance their functionality. Therefore there is a need for providing a new and improved headset/audio player interface apparatus which eliminates the troublesome wired connection and streamlines the use of headphones.

SUMMARY

One of the main uses of the apparatus according to an embodiment of the present invention is to listen to prerecorded audio files, music files, digital audio books, prerecorded lectures, language lessons, and other type of audio files that can be understood and enjoyed through the use of either ear by children and adults. The apparatus of the present invention is divergent from the standard class of audio listening devices in that:

- It can be used to its full extent with the MP3 player without the use of cables or wires.
- It provides hands free usage when being played and stored while in use.
- It provides full dual channel sound, leaving a second ear free to monitor the surrounding environment while being used.
- It can be used in full capacity during vigorous activity supported on or about either ear.
- All control functions of the audio player are integrated into the earhook headset.
- There is no disassembly of the headset in order to recharge the player's batteries or to program the audio content of the player.

It can be worn under headgear such as hats and heavy clothing and still provide the user with clear audio sound and easy access to controls.

A user can place the apparatus behind either ear quickly and securely in a matter of seconds. The apparatus unit can be stored in a small pocket ready for use without special set up or configuration.

According to a first embodiment of the apparatus/device, an earhook headset is provided which functions as a complete audio headset interface apparatus for a micro MP3 audio device providing a control switch for single or duplex single ear channel listening. The ear speaker configuration can be either external or internal. A 3.5 mm interface male jack is provided to connect the earhook to the headset jack of the MP3 audio player. A 3.5 mm interface female jack is provided for connecting a second audio ear speaker and also functions as the connection jack interface to the host programming computer for downloading programs and restoring power to the rechargeable batteries in the separate but connected MP3 audio player.

According to the first embodiment there is an audio headset adaptor apparatus comprising: a portable media player device having a power source and integrated control function buttons; an earhook assembly configured to operably connect to a portable media player device through a first interface jack connector, the earhook assembly comprising a flexible gripping earhook mountable behind an ear, the earhook having a top end and terminating at a bottom end at about behind the earlobe, the bottom end adjustable behind the ear; a first earphone portion comprising a first earbud with dual speakers and operably integrated with the earhook through a rotatable connection with a defined length of cable protruding from the top end of the earhook; an auxiliary jack socket integrated with the earhook behind the ear; and control circuitry housed within the earhook assembly, for controlling a set of integrated control functions manipulated by one or more switches located on the earhook assembly; wherein a first switch controls a single or dual channel audio in the first earphone portion, such that the switch in a first position activates a single speaker of the first earphone to play a first channel of the player's audio signal and the switch in a second position activates the dual speakers in the first earphone portion to play a first channel and second channel of the player's audio signal respectively.

According to a second embodiment of the apparatus, the earhook headset functions as a complete control apparatus as well as the audio interface for the micro MP3 audio device that provides control switches for volume control, channel change, power pause and single or duplex single ear channel listening. A 3.5 mm interface male jack is provided to connect the earhook to the headset jack of the MP3 audio player. A 3.5 mm interface jack is provided for connecting a second audio ear speaker and also functions as the connection jack interface to the host programming computer for downloading programs and restoring power to the rechargeable batteries in the separate but connected MP3 audio player.

According to the second embodiment there is an audio headset adaptor apparatus comprising: a portable media player device having a memory and a power source; an earhook assembly configured to operably connect to the media player device through a first interface connector, the earhook assembly comprising a flexible gripping earhook mountable behind an ear, the earhook having a top end and terminating at a bottom end at about behind the earlobe, the bottom end having an adjustably extendable and retractable compressive earspring; a plurality of button controller switches positioned to extend from the top end of the earhook for controlling the functions of the media player device; a first earphone portion operably integrated with the earhook, extending from the plurality of button controller switches from the top end of the earhook, the first earphone portion comprising a first earbud with dual speakers; a connection port integrated with the earhook behind the ear; a second earphone portion having a second earbud with a speaker for providing audio to the other ear, operably connected to a second interface connector through a defined length of cable and for connection with the connection port on the earhook assembly; and control circuitry for controlling a set of control functions, including control functions of the player device activated by the plurality of button controller switches; wherein a first switch controls a single or dual channel audio in the first earphone portion, such that the switch in a first position activates a single speaker of the first earphone to play a first channel of the player's audio signal and the switch in a second position activates the dual speakers in the first earphone portion to play a first channel and second channel of the player's audio signal respectively.

According to a third embodiment of the apparatus, an earhook headphone system is provided that incorporates an integrated MP3 player circuit. In addition to a speaker in the earhook, a 3.5 mm audio jack is used to provide the second channel connector stereo component when dual channel, dual ear listening by the user is deemed safe and preferred over single channel or single ear duplex sound. The apparatus further comprises a rechargeable power supply for the system, and control switches for volume, channel change, power on/off and single/duplex single ear channel listening.

According to this third embodiment, there is an audio headset system comprising: a component housing for housing a media player controller, a micro flash memory, and a battery power supply; a flexible gripping earhook assembly mountable behind an ear and integrated with the component housing such that the housing resides behind the ear, the earhook assembly having a top end and terminating at a bottom end at about behind the earlobe, wherein the bottom end having an adjustable earspring configured to contract inward toward the housing or extend outward to lengthen the earspring; a first earphone portion comprising a first earbud with dual speakers and operably integrated with the earhook assembly through a pivot connection with a defined length of cable protruding from the top end of the earhook assembly; an interface jack socket integrated with the earhook assembly and housed within the component housing; a plurality of control switches; control circuitry for controlling a set of integrated control functions manipulated by the plurality of switches; wherein a first switch controls a single or dual channel audio in the first earphone portion, such that the switch in a first position activates a single speaker of the first earphone to play a first channel of the player's audio signal and the switch in a second position activates the dual speakers in the first earphone portion to play a first channel and second channel of the player's audio signal respectively.

Headsets of this type typically have a small form factor. Accordingly, not much room is available for a user interface for the media player portion of the integrated headset/media player. In accordance with an embodiment of the invention, a minimal user interface may be provided that allows the user to select stopping and starting of playback of stored content, as well as control of recording. For example, small "start," "stop," and "record" buttons may be provided. Headsets of this type are typically stereo.

While in one embodiment, a headset with integrated media player according to the invention would remain stereo by using the two earphones, in another embodiment, the integrated headset/media player could be a stereo/dual channel headset that plays two channels of audio through one earphone (earbud). In still another embodiment, a monaural earphone in the headset with an optional second earpiece, to allow stereo operation if desired, could be provided. Selection of speaker combinations could be selected by a selector switch that selects single or dual channel mode for the main earphone (earbud) or dual channel mode by using the optional earphone (earbud).

Corresponding visual indicators, such as light-emitting diodes, might also be provided as an indication of the current operating mode. The playback mode may be a fixed sequential mode, or another mode such as a random playback mode, or successive presses of the "start" button may cycle through different playback modes.

The media player may be an audio player, capable, e.g., of playing audio files such as MPEG-3 ("MPEG-3/MP3") files. Optionally, the media player may include a recording function as well, so that a user can record voice notes. Similarly, voice recordings received on the user's headset could be uploaded for later off-line playback or downloaded to a computer for archival storage.

Alternatively, given the presence of a microphone in the headset, the media player could be configured to respond to voice commands, which could allow more complex commands, including commands to play particular content. In addition, the microphone could be used to detect the ambient noise level, and to adjust playback volume accordingly.

The same connection that is used to charge the headset, the connection jack interface, may also be used to load the media player, or to download any recording made using the recording function (if provided). Thus, where a USB connection is provided for charging from the USB port of a computer, that same connection could be used for uploading and downloading content files which, in addition to the aforementioned voice recording and recorded conversations, could be another type of audio file downloaded to a computer.

According to a fourth embodiment of the apparatus, an earhook headphone system is provided that incorporates an integrated MP3 player circuit and a removable memory card reader integrated into the earhook headset. In addition to a speaker in the earhook, a 3.5 mm audio jack is used to provide the second channel connector stereo component when dual channel, dual ear listening by the user is deemed safe and preferred over single channel or single ear duplex sound. The apparatus further comprises a rechargeable power supply for the system, and control switches for volume, channel change, power on/off and single/duplex single ear channel listening.

Another feature of the player incorporates the use of a removable micro memory card reader for the storage of audio pre-recorded and recorded audio files; for example existing recordings, audio books, training audios, lectures, language training, subliminal teaching audios. This feature allows the user to exchange the recorded memory card files with micro memory cards of the same physical configuration and format that have different recorded audio files. Additionally, recordings made by the headset when the headset is placed in the record mode may be recorded to the micro memory card and downloaded as files to a remote device such as a computer.

Additional embodiments of the present invention reflect configuration differences of the earhook headset in respect to location of switches incorporated into the headset, different configurations of earphone speakers used in the headset, and earhook headset configurations that interface with MP3 players that do not require external controls but can benefit a user by its use in an earhook mounted configuration.

Therefore, in accordance with the present invention, there is provided a headset including a speaker, memory for storing media files, and media circuitry including playback circuitry for playing back those media files through the speaker.

Other configuration embodiments according to the present invention also reflect the design of the headset to exploit the use of a flexible silicone spring "tail", also referred to as an "earspring", that aides in the stability of the headset about the ear during activity. The soft spring tail is an integral design of the structural elements of the earhook headset and serves to function as the gripping and stabilizing element of the earhook headset in securing the unit behind or near the ear. Other similar materials to silicone may be used as the material for the spring tail in providing a soft and gripping structure. The housing body itself may further comprise flexible and compressive elements, for example the housing body having a spring end itself, to aid in the overall comfort and stability of the earhook.

The apparatus may also comprise voice recording, integrated wireless, Bluetooth circuitry or Wi-Fi communications circuitry that interfaces with PDA's, computers, cell phones or other communication devices.

The apparatus may also comprise an integrated FM music player for the user to have access to FM quality radio broadcasts.

These features, advantages and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

FIG. 1 illustrates a front view of wearing a headset according to prior art.

FIG. 1A illustrates a right side view of wearing a headset according to prior art.

FIG. 1B illustrates a left side view of wearing a headset according to prior art.

FIG. 32D illustrates a bottom view of FIG. 32, according to an embodiment of the present invention.

Figure 2A:
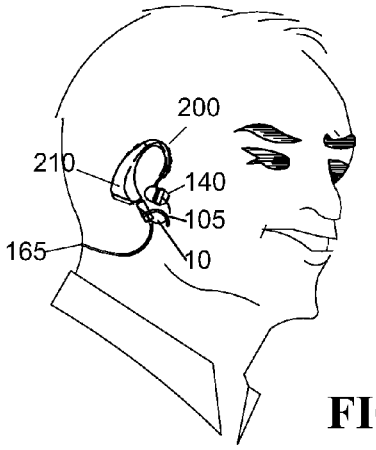
FIG. 2A illustrates a right side view of wearing a headset apparatus according to an embodiment of the present invention.

| Reference Numerals | |
|---|---|
| 1 | apparatus |
| 10 | user's ear |
| 11 | headphone |
| 13 | headphone audio cables |
| 14 | headband |
| 15 | audio player/MP3 player |
| 20 | audio device/MP3 player |
| 100 | silicon earhook assembly |
| 105 | silicon ear spring/springtail |
| 110 | silicon ear hook |
| 115 | verification circuit chip |
| 120 | delay coil |
| 125 | control circuit flex PCB |
| 140 | earbud dual speaker assembly |
| 141 | earbud cover |
| 142 | speaker cover |
| 143 | speaker high |
| 144 | speaker bass |
| 145 | speaker housing |
| 150 | silicon earhook body/housing |
| 151 | earhook subassembly/covers/phone jack assembly housing |
| 152 | phone jack assembly cover |
| 153 | dual speaker mode switch |
| 153A | dual speaker mode button |
| 154 | power slide switch |
| 155 | interface/MP3 phone jack (male jack) |
| 156 | headset jack of MP3 player |
| 157 | female audio connector/connection interface jack |
| 160 | earbud assembly single speaker |
| 161 | silicon earbud cover |
| 162 | speaker cover |
| 163 | speaker |
| 164 | speaker enclosure |
| 165 | earbud cable |
| 170 | earbud switch assembly |
| 171 | earhook switch PCB |
| 172 | switch body |
| 173 | up volume switch |
| 173A | up volume button |
| 174 | pause switch |
| 174A | pause button |

-continued

| Reference Numerals | |
|---|---|
| 175 | down volume switch |
| 175A | down volume button |
| 176 | flexible silicon earhook |
| 177 | speaker cover |
| 178 | speaker bass |
| 179 | headset ring clamp |
| 180 | earphone headset assembly |
| 181 | telescoping shaft |
| 182 | slide ring |
| 183 | earphone body |
| 184 | switch PCB assembly |
| 185 | switch face plate |
| 186 | switch button up volume |
| 187 | switch button pause |
| 188 | switch button down volume |
| 189 | speaker high |
| 190 | auxiliary phone jack |
| 195 | phone jack cover |
| 200 | MP3 earhook headset assembly |
| 205 | MP3 housing |
| 210 | MP3 housing with memory card |
| 215 | MP3 player circuit board |
| 225 | battery |
| 230 | remote earbud jack connection |
| 235 | removable memory card |
| 236 | memory card reader |
| 245 | power switch |
| 245A | power button |

DETAILED DESCRIPTION OF SPECIFIC EMBODIMENTS

The description above and below and the drawings of the present document focus on one or more currently preferred embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

As shown in a current configuration of earphones 11 with audio players 15, as shown in FIGS. 1, 1A, and 1B, such earphones 11 are cumbersome having entangling audio cable 13 and the conventional headband 14 or cable connector for connecting the bulky earphones 11 for each ear to comprise a typical headphone. Even with internal earbuds, such a configuration is still apparent with the annoyance of multiple cables 13 which easily tangle and the requirement to carry the audio player 15 to the body or clothing at a distance away from the ear phones.

Figure 2B:
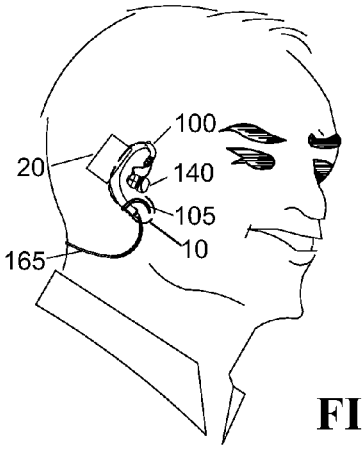
FIG. 2B illustrates a right side view of wearing a headset apparatus according to another embodiment of the present invention.
Figure 2C:
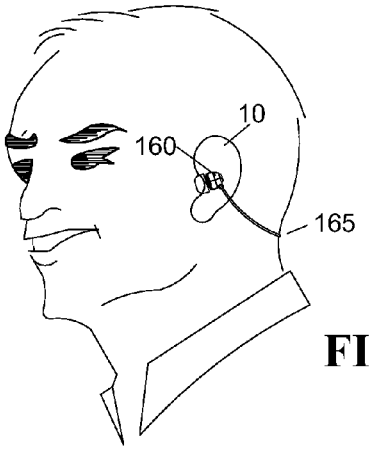
FIG. 2C illustrates a left side view of wearing a headset apparatus with speaker according to an embodiment of the present invention.
Figure 2:
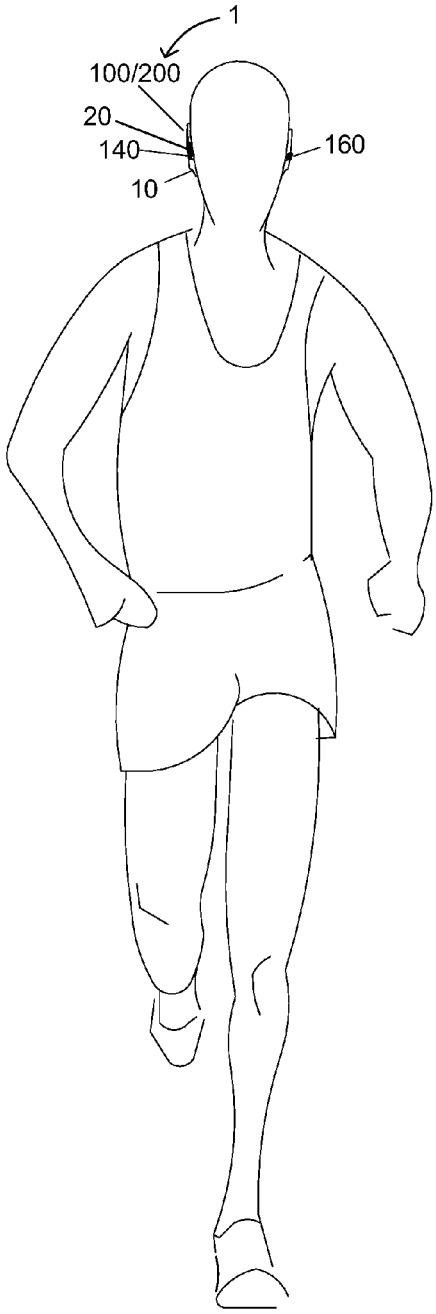
FIG. 2 illustrates a front view of wearing a headset apparatus according to an embodiment of the present invention.

As shown in FIGS. 2, 2A, 2B and 2C the earhook headset apparatus 1 is shown as worn on a user in accordance with embodiments of the apparatus. As shown, the apparatus 1 is worn as more discretely and conveniently on the user than a conventional headphone system. As shown in FIG. 2B the apparatus is placed on or behind the user's ear 10 by way of the earhook assembly 100 which is directly connected with an audio player device 20, such as an MP3 player device, resting comfortably behind the user's ear 10. There is an integrated ear speaker 140 with the earhook assembly 100 placed in or near the ear 10 and a corresponding optional ear speaker 160 for the other ear 10 connected by an earbud cable 165 as shown in FIG. 2C. The ear speaker 140 may serve as an earbud dual speaker assembly. In FIG. 2A, the apparatus is shown with an integrated MP3 player earhook headset assembly 200 where the MP3 player is integrated within a MP3 housing 210 of the earhook assembly 200 according to an embodiment. As further shown in FIGS. 2A and 2B, an adjustable earspring 105 is located at the end of the earhook assembly to provide for comfort and stability of the apparatus.

Figure 3:
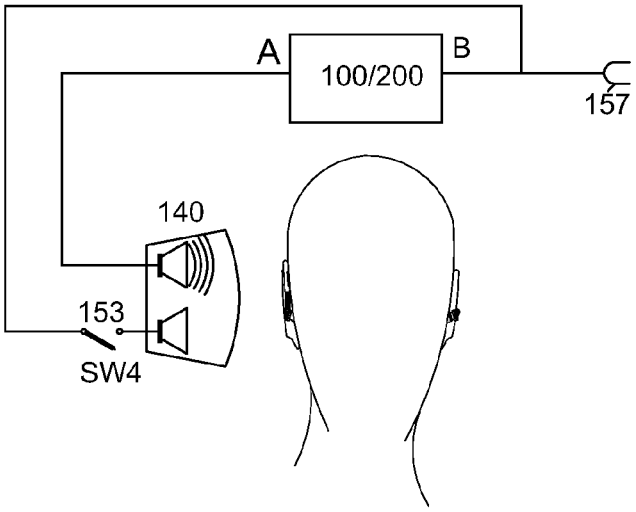
FIG. 3 is a schematic diagram of the single speaker activated mode of the headset apparatus in a single ear, according to an embodiment of the present invention.

In accordance with an embodiment of the apparatus, the earhook headset apparatus 1 is illustrated as worn on a user in FIG. 3, and allows the user to listen to the audio player's single channel audio output through a single speaker of earbud dual speaker assembly 140 into a single ear.

Figure 3A:
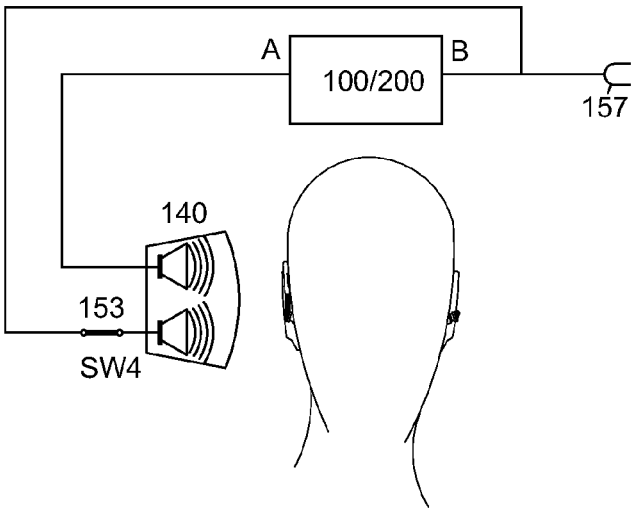
FIG. 3A is a schematic diagram of the dual speaker activated mode of the headset apparatus in a single ear configuration, according to an embodiment of the present invention.

In accordance with another embodiment of the apparatus, the earhook headset apparatus 1 is shown as worn on a user in FIG. 3A. When dual channel mode is chosen by a dual mode switch 153 (switch SW4), both channel "A" and channel "B" will play through the same earbud dual speaker assembly 140 in the earhook headset.

Figure 3B:
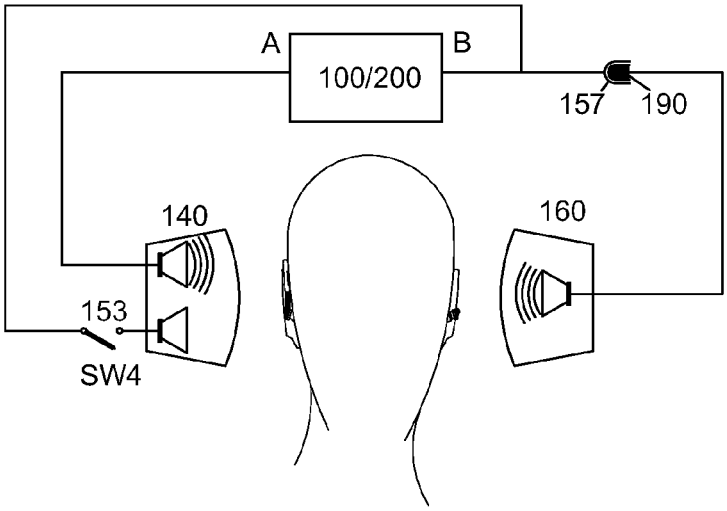
FIG. 3B is a schematic diagram of the single speaker in each ear activated mode of the headset apparatus in a dual ear configuration, according to an embodiment of the present invention.

In accordance with another embodiment of the apparatus, the earhook headset apparatus 1 is shown as worn on a user in FIG. 3B. When SW4 (control switch 153) is deselected, only the "A" channel will play through earbud dual speaker assembly 140 and the channel "B" earbud speaker assembly 160 may be used to hear audio in the other ear when earbud speaker assembly 160 is connected through auxiliary jack 190 to audio jack 157 of the earhook assembly housing 150.

Figure 4:
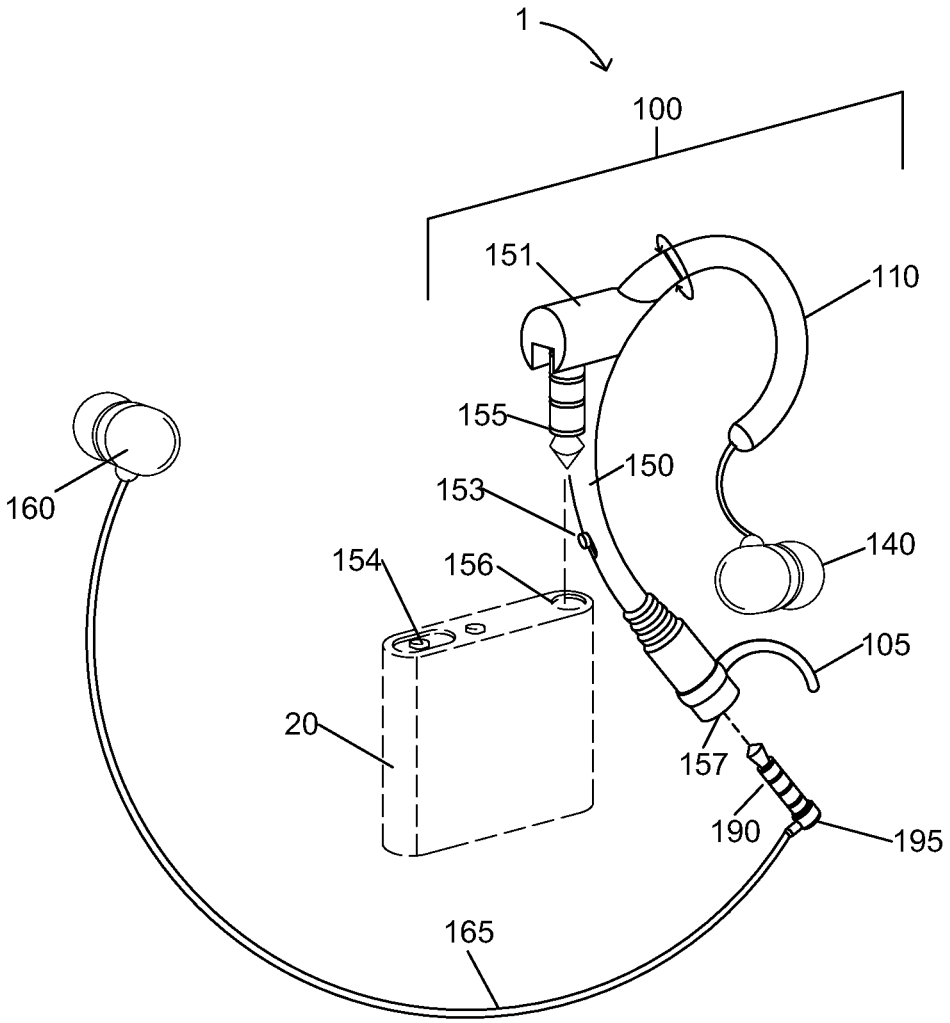
FIG. 4 illustrates a right side perspective view of a digital audio player adapted MP3 earhook adaptor headset without controls, according to an embodiment of the present invention.

The apparatus 1 is shown in FIG. 4, which illustrates a right side perspective view of a digital audio player adapted MP3 earhook adaptor headset 100 without controls, according to an embodiment of the present invention. The apparatus functions as a complete audio headset interface apparatus for a micro MP3 audio device 20, comprising a control switch 153 for single/duplex single ear channel listening located on the housing 150. The ear speaker configuration can be either external or internal. An interface phone jack 155 (male jack) such as a 3.5 mm interface phone jack is provided to connect the earhook assembly 100 to the headset jack 156 of the MP3 audio player 20. An interface phone jack socket 157 (female socket) such as a 3.5 mm interface phone jack socket is provided within the phone jack assembly housing 150 for connecting a second audio ear speaker 160 and also functions as the auxiliary connection interface jack to the host programming computer for downloading programs and restoring power to the rechargeable batteries in the separate but connected MP3 audio player 20. The female jack socket 157 is located at the lower end of the housing 150. The second audio phone jack 190 corresponds to the female jack socket 157. A phone jack cover 195 covers an end of the second audio phone jack 190 and connects with the earbud cable 165. An on/off power slide switch 154 is further provided on the MP3 player.

Figure 5:
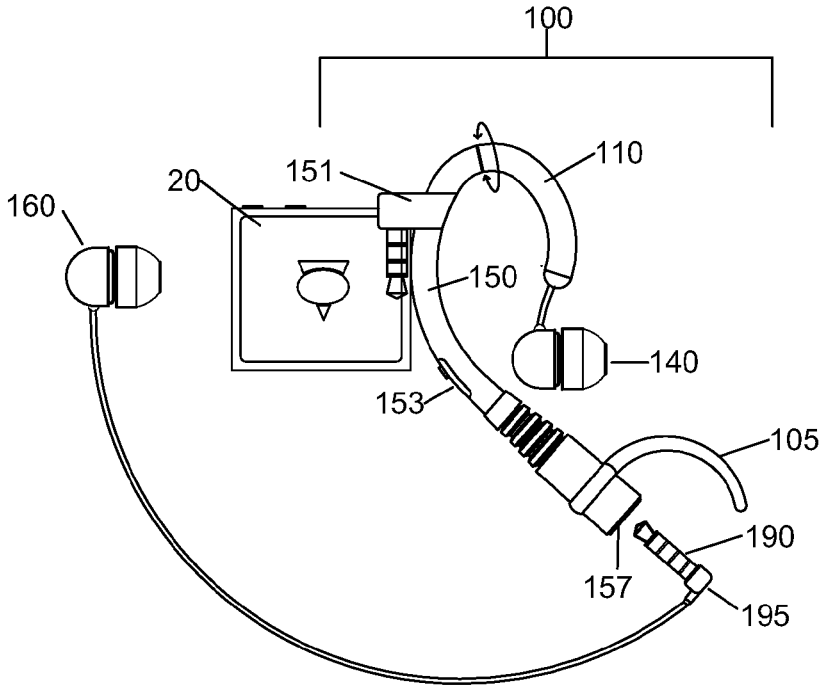
FIG. 5 illustrates a right side view of the apparatus of FIG. 4, according to an embodiment of the present invention.
Figure 6:
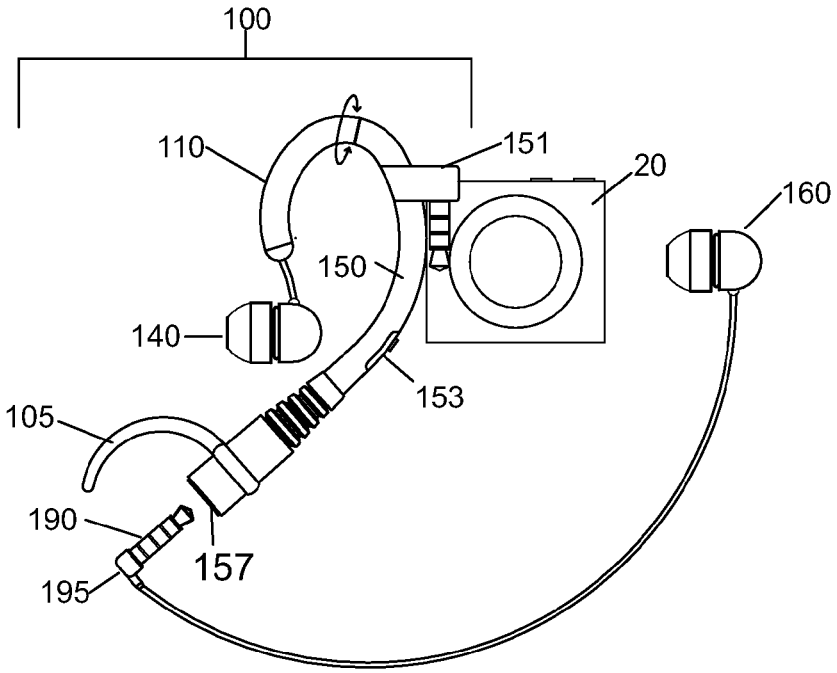
FIG. 6 illustrates a left side view of the apparatus of FIG. 4, according to an embodiment of the present invention.

Therefore, it is a primary object of the embodiments of the present invention to provide an earhook headphone adaptor for micro MP3 players 20 playing MP3 audio files. The earhook headset apparatus 1 as shown in FIG. 4, has a configuration according to an embodiment comprising of at least one speaker 140, a 3.5 mm male jack 155 and a female audio jack 157, and a mono/duplex speaker mode switch 153. FIG. 5 and FIG. 6 illustrate a right side and left side view of the apparatus of FIG. 4 respectively. The earhook assembly 100 is fixable precisely at a position behind the user's ear 10 and the speaker assembly 140, 160 are put in close proximity to the ear canal. The earhook assembly 100 comprises a silicon earhook 110 mountable behind the top of the ear, an earhook subassembly 151 for housing the phone jack 155, the earhook housing/body 150 curving along the shape of the back of the ear and terminating at the end with a female jack socket 157, and a silicon earspring 105. The earhook 110 has a gripping characteristic through the silicon material and is also flexible. The earhook 110 is rotatably connected to the housing 150.

Figure 7:
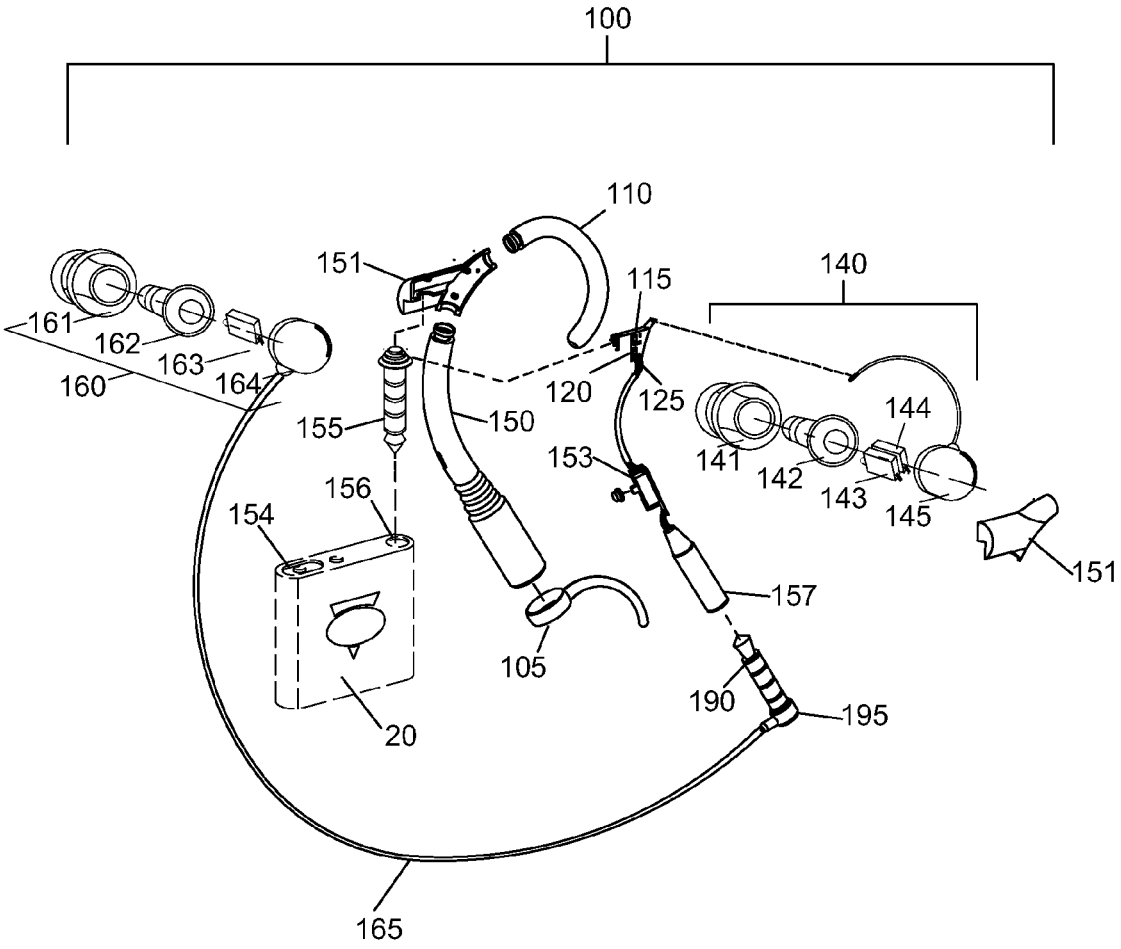
FIG. 7 illustrates an exploded assembly view of the apparatus of FIG. 4, according to an embodiment of the present invention.

FIG. 7 illustrates an exploded assembly view of the apparatus of FIG. 4. The exploded view of the components of the earhook assembly 100 comprises the earhook housing 150, shown with the earhook 110 detached, the subassembly 151 disassembled into two covers for housing the MP3 phone jack 155 and the earspring 105 detached from the lower end of the housing 150. As shown, the lower end of the housing 150 comprises a compressive section to allow for further comfort adjustment of the earspring 105. Earspring 105 comprises an arc-like tail profile originating from a ring aperture and terminating to an end point such that the earspring 105 rests comfortably and stably against the lower rear of the ear. MP3 player 20 is attached to the MP3 interface jack 155 through the headset jack 156 of the MP3 player. Within the phone jack subassembly 151 and housing 150 is a PCB 125 that supports the MP3 "Circuit Verification Module" 115 for the recognition of the remote control switches by the MP3 player 20 and the "Audio 'Channel B' delay coil" 120 for the simulated stereo effect of the channel "B" speaker 144 in the earbud speaker assembly 140. By using the "Dual Channel" mode switch 153, the user can listen to the "A" and "B" channel audio through one earbud and have the ability of monitoring the surrounding environment with their other available ear. Connection interface jack 157 further resides within the housing 150 for connection with the auxiliary audio jack 190.

The integrally attached compact dual speaker earbud unit assembly 140 consists of a speaker housing 145, full range unit speaker 143, a mid range unit speaker 144, speaker cover 142 and earbud cover 141. Earbud assembly 160 may be used to hear audio in other ear when remote earbud assembly 160 is connected through earbud cable 165 to audio jack 190 for connection with phone jack interface 157 of the assembly housing 150. Earbud assembly 160 further comprises a silicone earbud cover 161, speaker cover 162, speaker 163, speaker enclosure 164.

Figure 8:
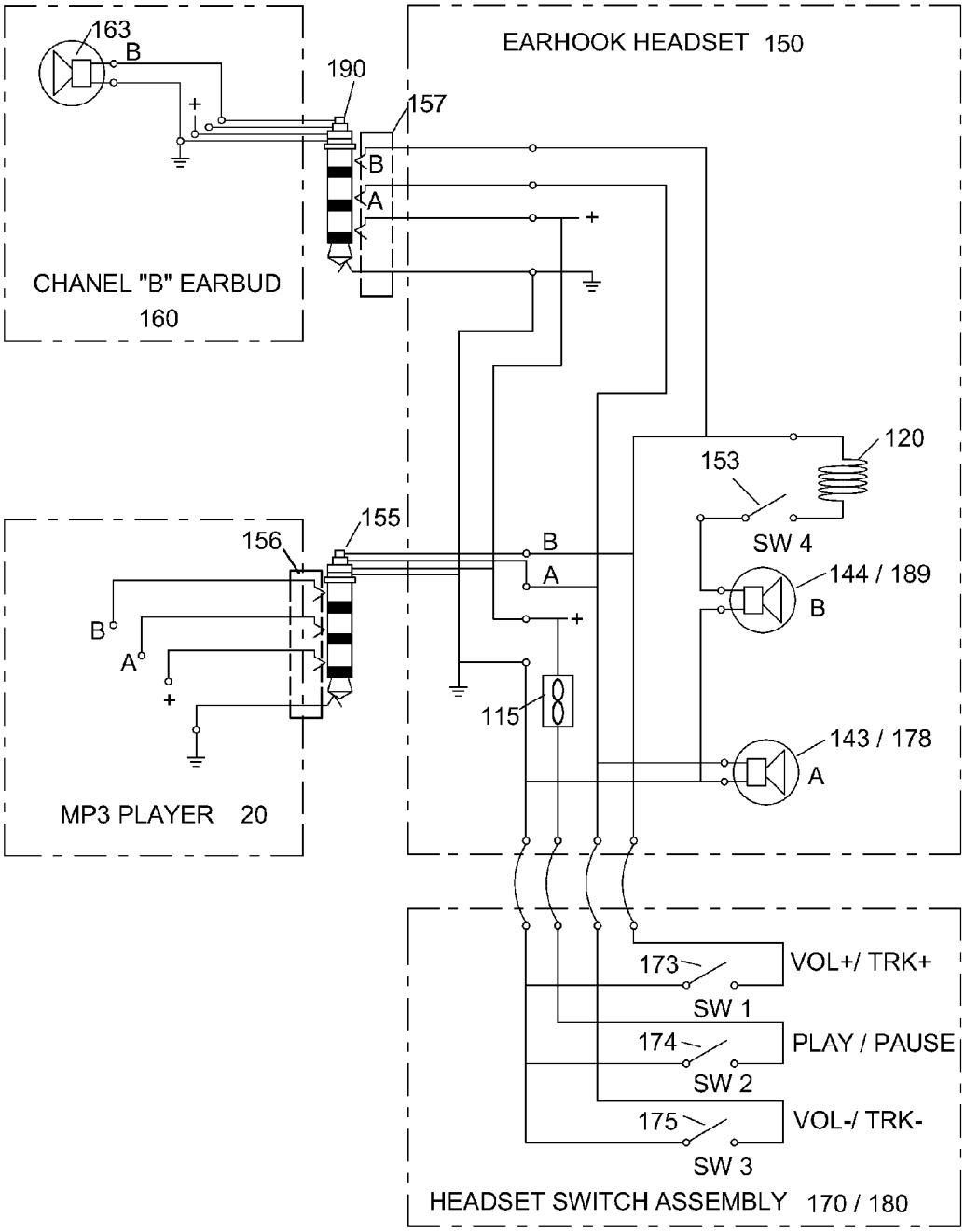
FIG. 8 illustrates a schematic plan diagram of the apparatus according to an embodiment of the present invention.

FIG. 8 illustrates the schematic diagram of the apparatus according to an embodiment of the present invention. As shown, the diagram details the functional electrical circuit of the earhook headset housing 150. The basic system components of the headset comprise an earhook headset housing 150; headset switch assembly 170, 180; MP3 interface jack 155; MP3 player 20; headset jack 156 of the MP3 player; and a remote channel "B" earbud speaker 160. The main function of the earhook circuit includes the remote control function of the headset switches in the switch assembly 170, 180, to control the MP3 player functions of: (1) SW1. Up Volume/Up Track 173; (2) SW2. Play/Pause 174; and (3) SW3. Down Volume/Down Track 175. Accordingly to an embodiment, the control switch assembly 170, 180 is located at the top front of the earhook headset in order to make changing MP3 mode functions easily accessible to the user.

Located just below the switch assembly 170, 180 is the attached dual speaker earbud unit assembly 140. The earbud circuit consists of a full range unit speaker 143, 178 and a mid range unit speaker 144, 189. According to an embodiment, when dual channel mode is chosen by SW4 153 (dual mode switch), both channel "A" and channel "B" will play through the same earbud in the earhook headset. When SW4 is deselected, only the "A" channel will play through earhook headset 140 and the channel "B" earbud speaker 160 may be used to hear audio in other ear when earbud speaker 160 is connected to audio jack 190 of the phone jack interface 157 of the assembly housing 150.

Within the phone jack interface assembly is a PCB 125 that supports the MP3 "Circuit Verification Module" 115 for the recognition of the remote control switches by the MP3 player and the "Audio 'Channel B' delay coil" 120 for the simulated stereo effect of the channel "B" speaker 144 in the earhook headset earbud 140. By using the "Dual Channel" mode of the earbud headset, the user can listen to the "A" and "B" channel audio through one earbud and have the ability of monitoring the surrounding environment with their other available ear.

Figure 9:
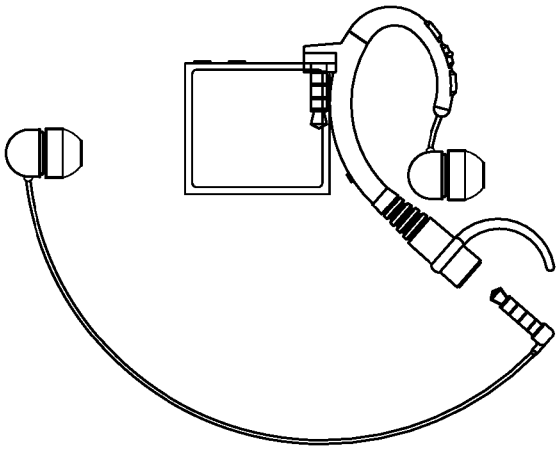
FIG. 9 illustrates a right side view of a digital audio player adapted MP3 earhook adaptor headset with headset controls and earbud speakers, according to an embodiment of the present invention.
Figure 9B:
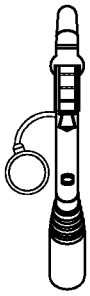
FIG. 9B illustrates a rear view of the apparatus of FIG. 9, according to an embodiment of the present invention.
Figure 9A:
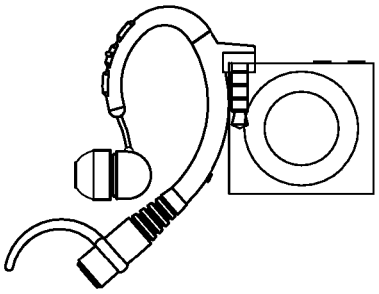
FIG. 9A illustrates a left side view of the apparatus of FIG. 9, according to an embodiment of the present invention.
Figure 9C:
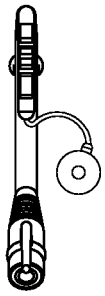
FIG. 9C illustrates a front view of the apparatus of FIG. 9, according to an embodiment of the present invention.
Figure 9D:
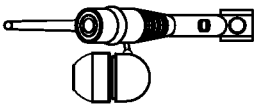
FIG. 9D illustrates a bottom view of the apparatus of FIG. 9, according to an embodiment of the present invention.
Figure 9E:
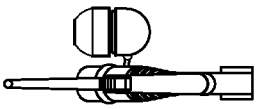
FIG. 9E illustrates a top view of the apparatus of FIG. 9, according to an embodiment of the present invention.

FIGS. 9-9D illustrate another embodiment of the apparatus in which the earhook headset 1 functions as a complete control apparatus as well as the audio interface for the micro MP3 audio device 20. As shown, FIG. 9 illustrates a right side view of a digital audio player adapted MP3 earhook adaptor headset with headset controls and earbud speakers, according to an embodiment of the present invention. FIG. 9A illustrates a left side view, FIG. 9B illustrates a rear view, FIG. 9C illustrates a front view, FIG. 9D illustrates a bottom view and FIG. 9E illustrates a top view of the apparatus respectively. Within the silicon earhook switch body 172, there is an earbud control switch assembly 170 for controlling volume, channel change, power pause and single/duplex single ear channel listening. (See FIG. 11)

Figure 9F:
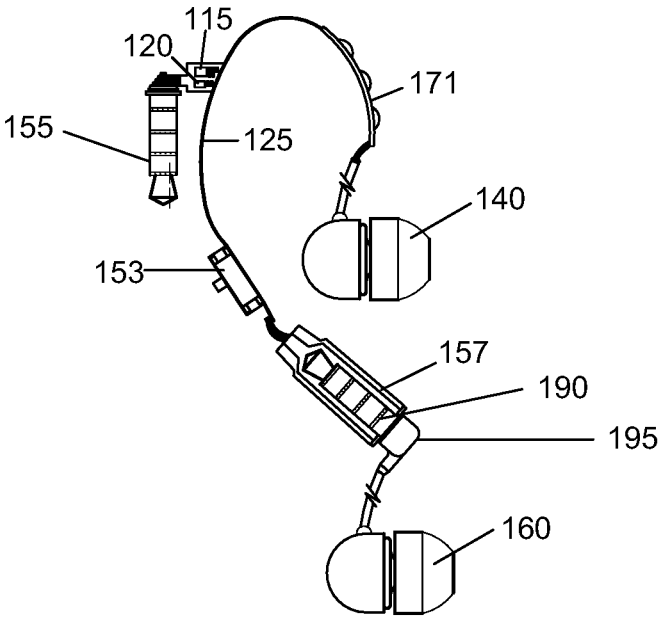
FIG. 9F illustrates a right side view of the basic electronic component assembly of the apparatus of FIG. 9, according to an embodiment of the present invention.

FIG. 9F illustrates an assembly of the active electronic components according to an embodiment of the present invention. As shown, the diagram details the functional electrical components of the earhook headset. The basic active components of the headset comprise an male audio jack 155; control circuit PCB assembly 125; circuit components 120, 115; mode control switches PCB 171; dual speaker mode switch 153; female audio connector 157 housed within the housing body 150; auxiliary phone jack 190; dual speaker earbud 140; single speaker remote channel "B" earbud speaker 160. The main function of the earhook components includes the remote control function of the headset switches in the switch assembly 170, 180, to control the MP3 player functions of: (1) SW1. Up Volume/Up Track 173; (2) SW2. Play/Pause 174; and (3) SW3. Down Volume/Down Track 175. Accordingly to an embodiment, the control switch assembly 170, 180 is located at the top front of the earhook headset, for example the switch body 172 of the earhook, in order to make changing MP3 mode functions easily accessible to the user.

Figure 10:
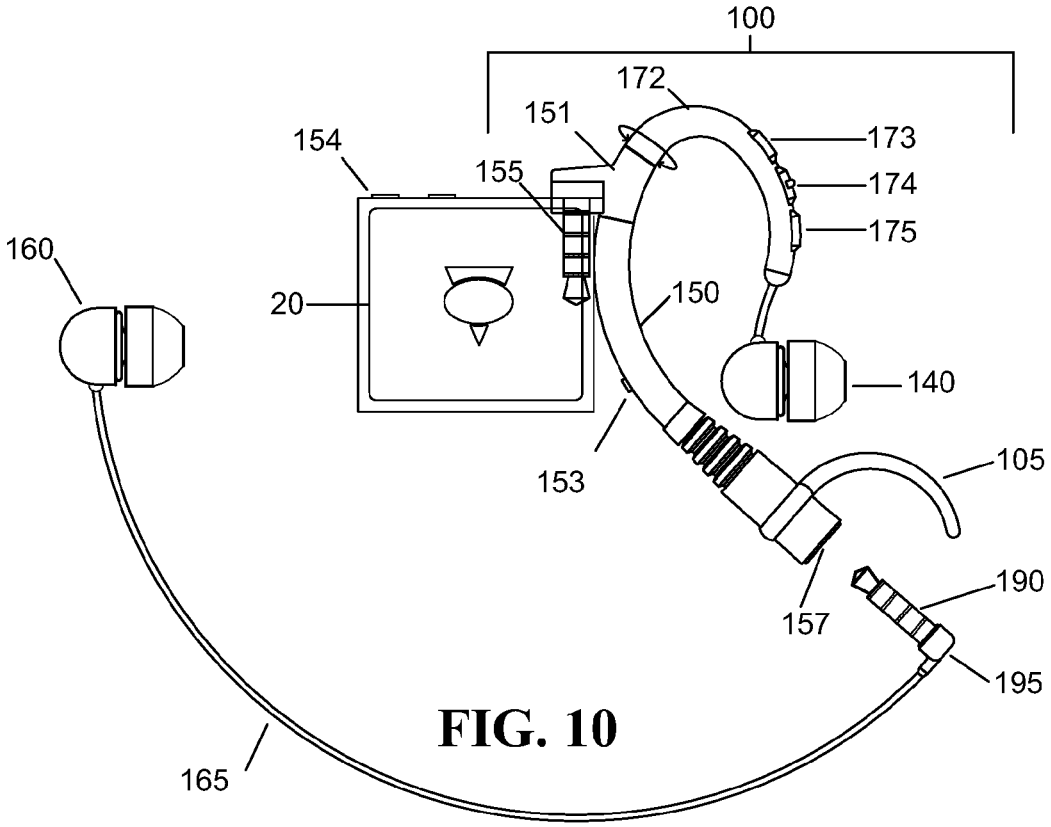
FIG. 10 illustrates a right side view of the apparatus of FIG. 9, according to an embodiment of the present invention.

As further shown in FIG. 10, an interface male jack 155 is provided to connect the earhook assembly 100 to the headset jack of the MP3 audio player 20. An example of an audio player 20 to which the earhook headset is adapted to is the Ipod Shuffle®. An interface female jack socket 157 is provided within the phone jack assembly housing 150 for connecting a second audio ear speaker 160 and also functions as the connection jack interface to the host programming computer for downloading programs and restoring power to the rechargeable batteries in the separate but connected MP3 audio player 20. The second audio phone jack 190 corresponds to the female jack socket 157. A phone jack cover 195 covers an end of the second audio phone jack 190 and connects with the earbud cable 165. An on/off (power) slide switch 154 is further provided on the MP3 player 20. As shown, there is a flexible silicone earspring 105 that may be situated at the lower end of the housing 150. The lower end of the housing 150 comprises a compressive section to allow for further comfort adjustment of the earspring 105. The earspring 105 is further adjustable along the length of the lower part of the housing 150.

Figure 10A:
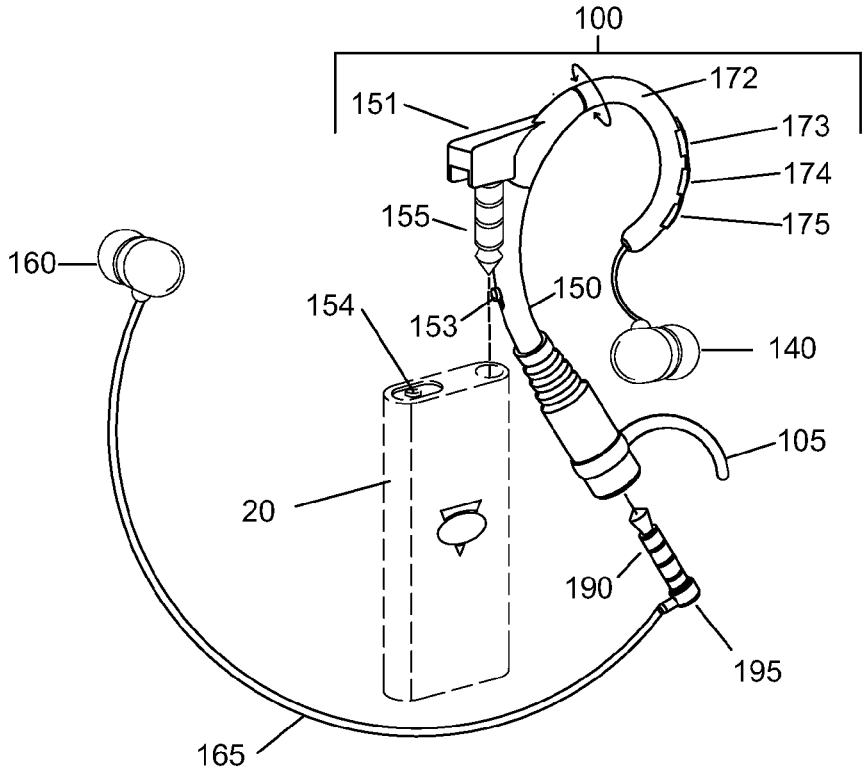
FIG. 10A illustrates a right side perspective view of the apparatus of FIG. 9, according to an embodiment of the present invention.

FIG. 10A further illustrates a perspective view of the apparatus providing earbud volume up control switch 173, power pause switch 174, volume down control switch 175, located on the switch body 172, and single/duplex single ear channel listening 153. In this embodiment, the earhook assembly 100 is connected with an earbud dual speaker assembly 140.

Figure 11:
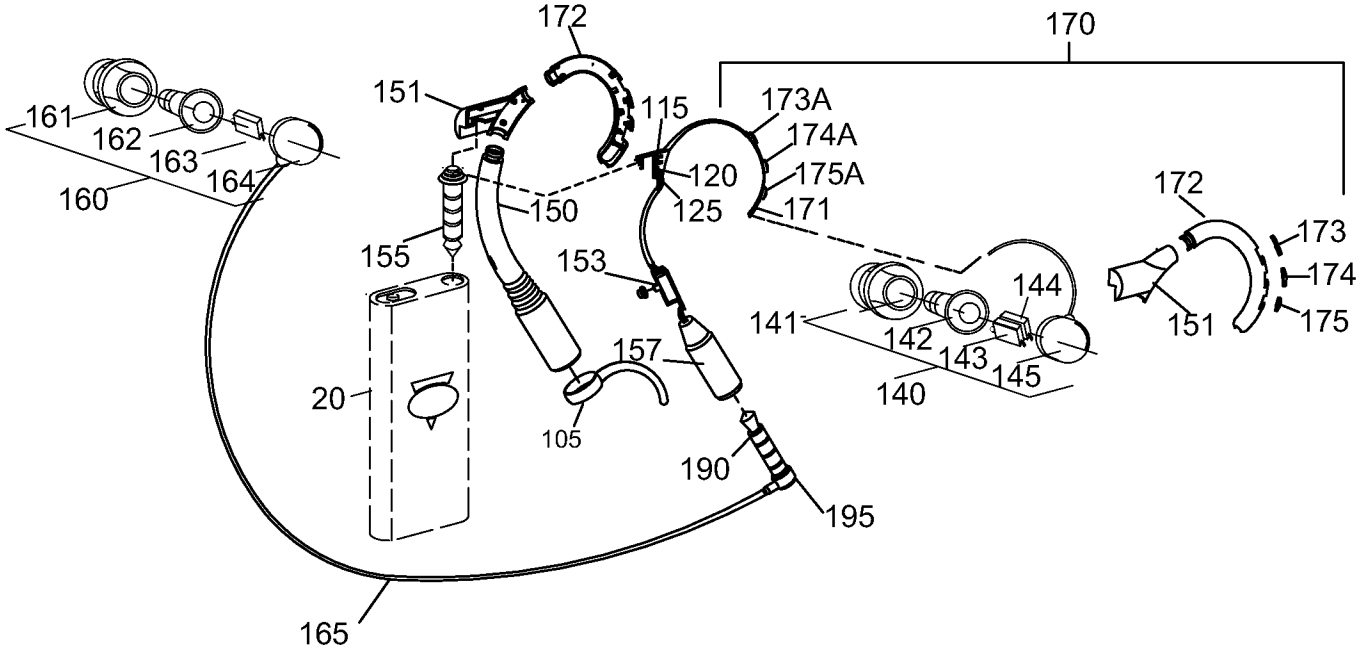
FIG. 11 illustrates an exploded assembly view of the apparatus of FIG. 9, according to an embodiment of the present invention.

As more particularly illustrated in the exploded view of FIG. 11, the earbud dual speaker assembly 140 comprises of an earbud cover 141, a speaker cover 142, speaker high 143 (i.e. a full range speaker) and speaker bass 144 (i.e. a mid range speaker), contained within the speaker housing 145. The speaker assembly 140 is connected with and controlled by the earbud switch assembly 170 comprising a switch body 172 housing a switch PCB 171, an up volume switch 173 with associated up volume button 173A, a pause switch 174 with associated pause button 174A and a down volume switch 175 with associated down volume button 175A. As further shown, the phone jack assembly housing 150 is formed with subassembly 151 covers which encase the male jack 155, and the subassembly 151 covers are secured by press fitting the two halves together. The housing 150 at the lower part encases the female jack socket 157. At a first distal end, the housing 150 terminates with the dual speaker mode selector switch 153 attached through which the second audio phone jack 190 enters. At a second distal end of the housing 150, the subassembly covers 151 are rotatably engaged with the housing 150 and the rear of the earhook switch body 172 also rotatably engages with the subassembly covers 151 to form a tight and stable fit. The subassembly covers 151 may be formed of a plastic or metal material and are configured for a snap fit connection to each other and rotatable connection to the rear of the earhook switch body 172. The subassembly cover 151 further houses the control circuit PCB 125 comprising a verification circuit chip 115 and delay coil 120. The flexible silicon housing 150 further houses the dual speaker mode switch 153, which lays open to the surface of the housing 150 for manual control by the user. The opposing earbud assembly 160 comprises an earbud cover 161, a speaker cover 162, and a speaker 163 which are housed within a speaker enclosure 164. Each of the switch buttons and earbud covers 161 and 141 may be formed of silicone material(s).

Similarly in another embodiment, as shown in FIGS. 12, 12A and 13-13E, the apparatus 1 also functions as a complete control apparatus as well as the audio interface for the micro MP3 audio device 20 in which the earhook assembly 100 is connected with an adjustable earphone headset assembly 180. In this configuration the adjustable earphone headset assembly is adjusted by way of sliding the headset assembly 180 which is integral with the earphone. Similar to FIG. 11, an interface male jack 155 is provided to connect the earhook assembly 100 to the headset jack of the MP3 audio player 20. An example of an audio player 20 to which the earhook headset is adapted to is the Ipod Shuffle®. An interface female jack socket 157 is provided within the phone jack assembly housing 150 for connecting a second audio ear speaker 160 and also functions as the connection jack interface to the host programming computer for downloading programs and restoring power to the rechargeable batteries in the separate but connected MP3 audio player 20. The interface jack socket 157 serves as a wired data connection port configured to connect with a USB port or serves as a USB port itself. The second audio phone jack 190 corresponds to the female jack socket 157. A phone jack cover 195 covers an end of the second audio phone jack 190 and connects with the earbud cable 165. An on/off slide switch 154 is further provided on the MP3 player 20.

Figure 12:
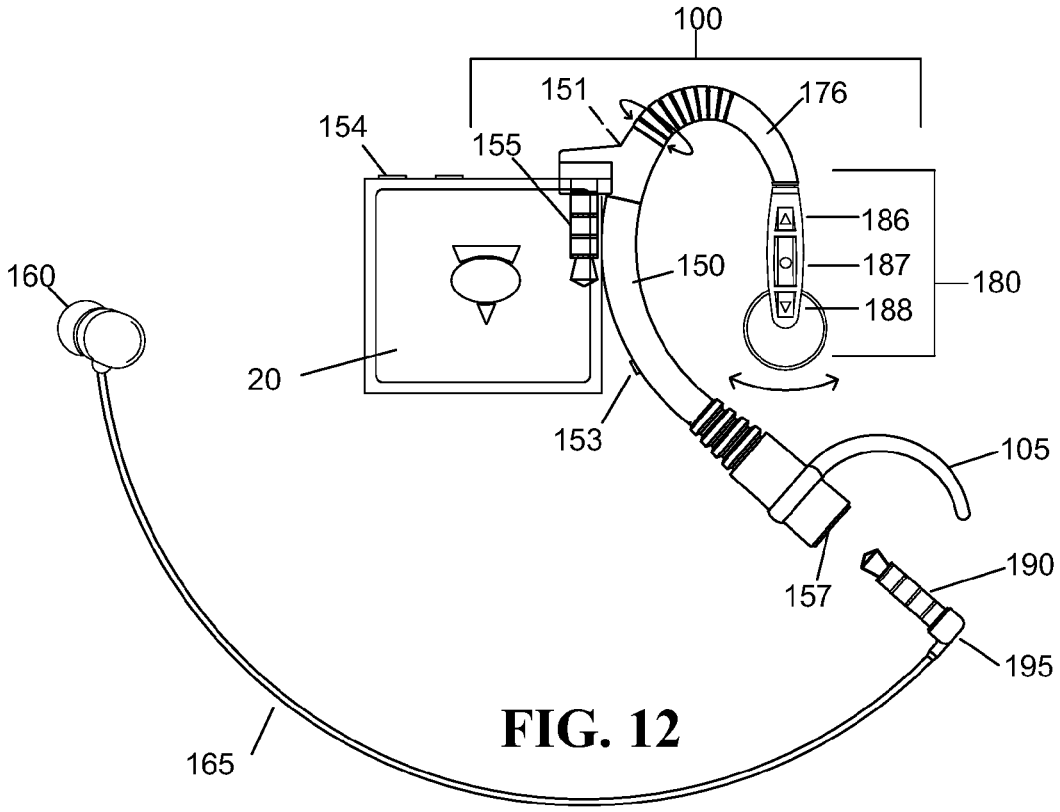
FIG. 12 illustrates a right side view of a digital audio player adapted MP3 earhook adaptor headset with headset controls and headphone speakers, according to an embodiment of the present invention.
Figure 12A:
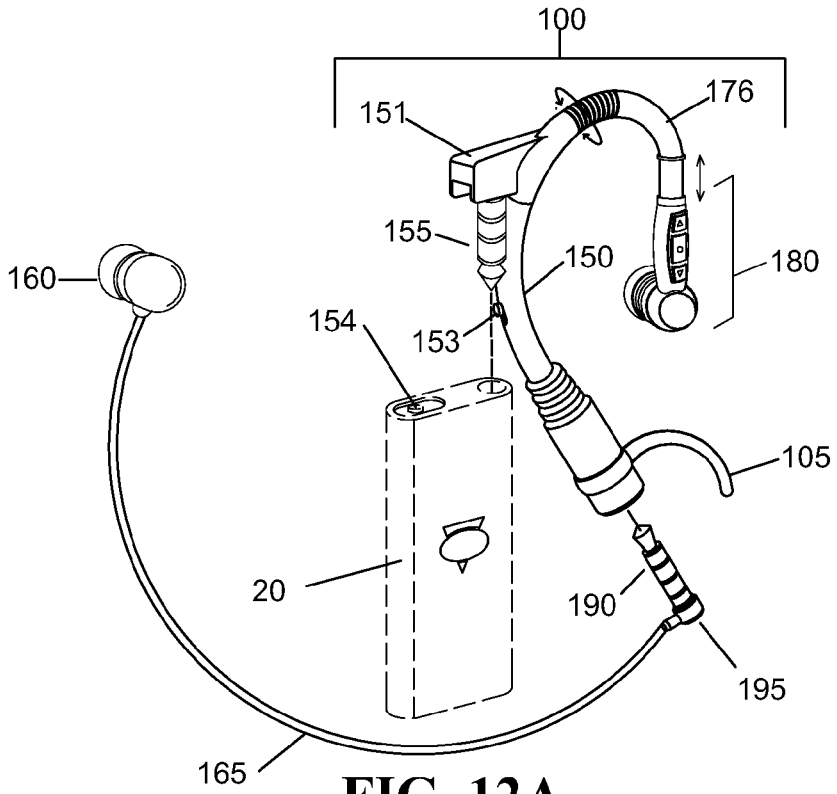
FIG. 12A illustrates a right side perspective view of the apparatus of FIG. 12, according to an embodiment of the present invention.
Figure 13B:
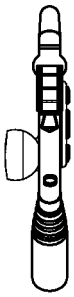
FIG. 13B illustrates a rear view of the apparatus of FIG. 12, according to an embodiment of the present invention.
Figure 13A:
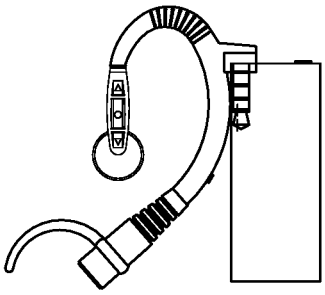
FIG. 13A illustrates a left side view of the apparatus of FIG. 12, according to an embodiment of the present invention.
Figure 13C:
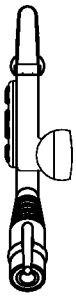
FIG. 13C illustrates a front view of the apparatus of FIG. 12, according to an embodiment of the present invention.
Figure 13D:
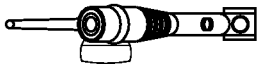
FIG. 13D illustrates a bottom view of the apparatus of FIG. 12, according to an embodiment of the present invention.
Figure 13E:
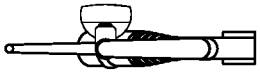
FIG. 13E illustrates a top view of the apparatus of FIG. 12, according to an embodiment of the present invention.

FIG. 12 further illustrates a side view of the apparatus providing control switch buttons of the earphone headset assembly 180 for controlling the increase in volume 186, pause 187, and the decrease of volume 188, according to an embodiment of the present invention. The earhook assembly 100 comprises a flexible swivel neck earhook 176 with flexible compression. The earhook 176 is swivel connected at one end to the top of the earphone headset assembly 180 and rotatably connected to the earhook subassembly 151 at the other end. A flexible silicone earspring 105 is situated at the lower end of the housing 150. As shown, the lower end of the housing 150 comprises a compressive section to allow for further comfort adjustment of the earspring 105. The earspring 105 is further adjustable along the length of the lower part of the housing 150. The earphone headset assembly 180 swivels to allow for adjustability of the earphone to fit the user's ear. As further shown in FIG. 12A, the earphone headset assembly 180 is further adjustable in the vertical direction as it is telescopically lengthens or shortens as required by the user. FIGS. 13A-13E further show the earhook assembly 100 from a side, rear, front, bottom and top view respectively.

Figure 14:
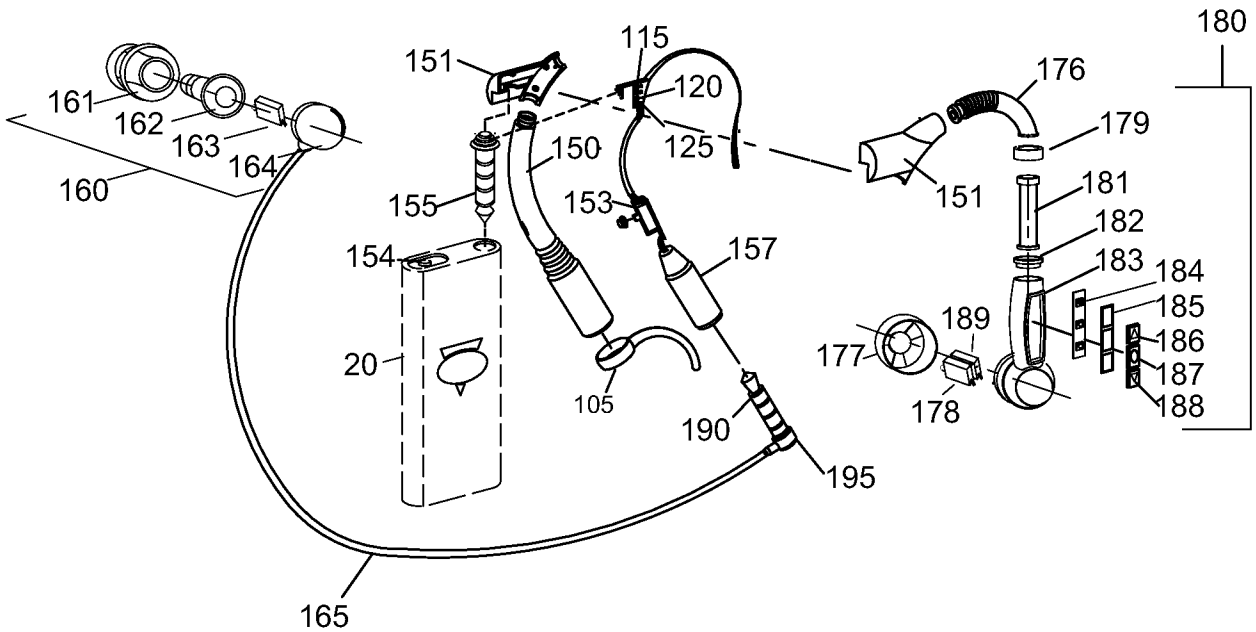
FIG. 14 illustrates an exploded assembly view of the apparatus of FIG. 12, according to an embodiment of the present invention.

As more particularly illustrated in the exploded view of FIG. 14, the headset assembly 180 comprises a headset ring clamp 179 at one end connected with a top end of the earhook 176, a telescoping shaft 181 through a slide ring 182, in connection with the earphone body 183. The earphone body 183 further comprises the control switches including the switch PCB 184, a switch face plate 185, the switch buttons for control of volume up 186, volume down 188 and power pause 187. The earphone body terminates with the earbud dual speaker assembly comprising a speaker cover 177, speaker high 189 and speaker bass 178. Single/duplex single ear channel listening is controlled by the dual speaker mode switch 153 on the housing 150. As similarly shown in FIG. 11, the components of the housing 150 and the connections to the opposing earbud assembly 160 are shown in the exploded view of FIG. 14. Each of the switch buttons 186, 187, 188 and earbud covers may be formed of silicone material(s).

Figure 15:
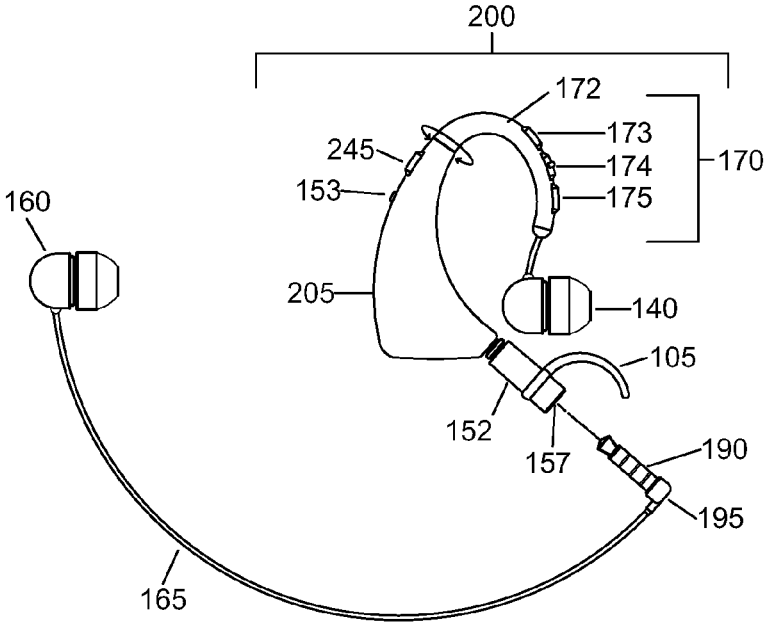
FIG. 15 illustrates a right side view of an integrated MP3 player earhook headset with headset controls and earbud speakers, according to an embodiment of the present invention.
Figure 15B:
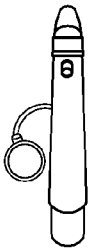
FIG. 15B illustrates a rear view of the apparatus of FIG. 15, according to an embodiment of the present invention.
Figure 15A:
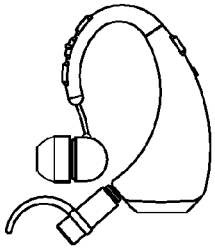
FIG. 15A illustrates a left side view of the apparatus of FIG. 15, according to an embodiment of the present invention.
Figure 15C:
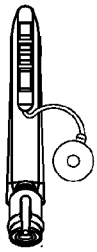
FIG. 15C illustrates a front view of the apparatus of FIG. 15, according to an embodiment of the present invention.
Figure 15D:
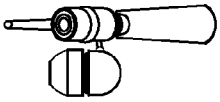
FIG. 15D illustrates a bottom view of the apparatus of FIG. 15, according to an embodiment of the present invention.
Figure 15E:
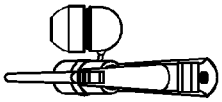
FIG. 15E illustrates a top view of the apparatus of FIG. 15, according to an embodiment of the present invention.
Figure 16:
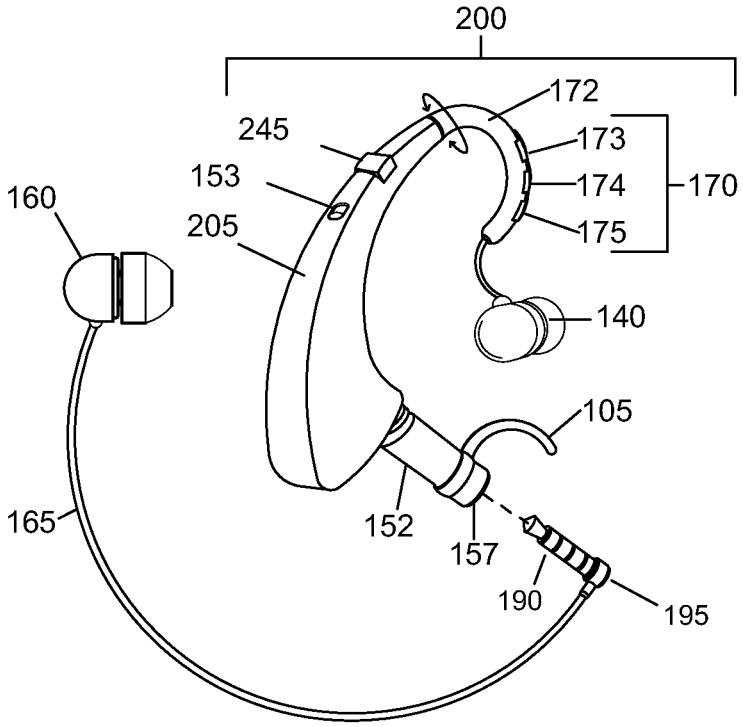
FIG. 16 illustrates a right side perspective view of the apparatus of FIG. 15, according to an embodiment of the present invention.

As illustrated in FIGS. 15-15E, an earhook player headset system according to another embodiment is provided that incorporates an integrated MP3 player earhook headset with headset controls and earbud speakers. The earhook assembly 200 comprises an MP3 housing 205 for housing a circuit board 215, and having headset controls by way of earbud switch assembly 170 and earbud speakers. In addition to a speaker assembly 140 in the earhook switch body 172, a 3.5 mm audio jack 190 covered by jack cover 195 is positioned in the connection interface jack 157 of the MP3 assembly 200, and is used to provide the second channel connector stereo component when dual channel, dual ear listening by the user is deemed safe and preferred over single channel or single ear duplex sound. Connection interface jack 157 is encased by assembly cover 152 flexibly abutting the end of the housing 205. As shown, there is a flexible silicone earspring 105 that may be positioned around the assembly cover 152 and adjusted to rest comfortably and stably against the lower rear of the ear. The control switches for volume, channel change, pause is located in the earbud switch assembly 170. FIG. 15 and FIG. 16 illustrate a side view and perspective view of the apparatus respectively, providing earbud volume up control switch 173, pause switch 174, volume down control switch 175, and single/duplex single ear channel listening switch 153 and power switch 245 are provided on the assembly housing 205. FIGS. 15A-15E further show the earhook assembly 200 without the remote earbud assembly 160 and cable 165, from a side, rear, front, bottom and top view respectively.

Figure 17:
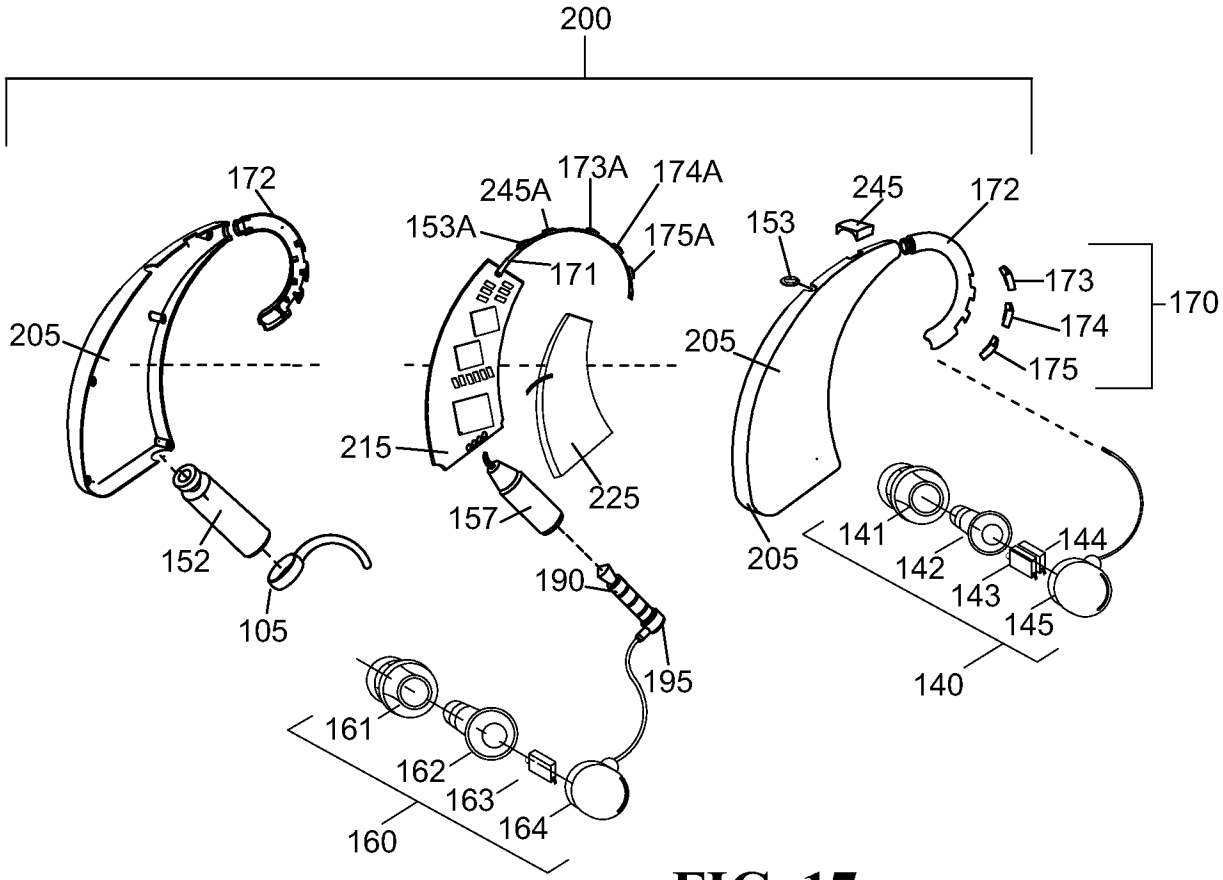
FIG. 17 illustrates an exploded assembly view of the apparatus of FIG. 15, according to an embodiment of the present invention.

As detailed in FIG. 17, MP3 earhook assembly 200 is illustrated in exploded view. The assembly 200 comprises housing components 205 for attachment to a rear section of the earhook switch body 172, housing an MP3 player circuit board 215, a rechargeable power supply battery 225 for the system, a remote earbud jack connector 157 for engaging with the audio phone jack 190. The jack connector 157 also functions as the connection jack interface to the host programming computer for downloading programs and restoring power to the rechargeable batteries 225. The housing components 205 may be made of a plastic or metal material and configured for a snap fit connection to each other and rotatable (threaded) connection with the rear section of the earhook switch body 172. The speaker dual mode switch 153 is further contained within the assembly 200 in which the switch 153 lays atop the surface of the housing 205 for manual control by the user.

The speaker assembly 140 is connected with and controlled by the earbud switch assembly 170 comprising a switch body 172 housing a switch PCB 171, an up volume switch 173 with associated up volume button 173A, a pause switch 174 with associated pause button 174A and a down volume switch 175 with associated down volume button 175A. An associated dual speaker mode button 153A and power switch button 245A are further provided on the switch PCB 171.

Figure 18:
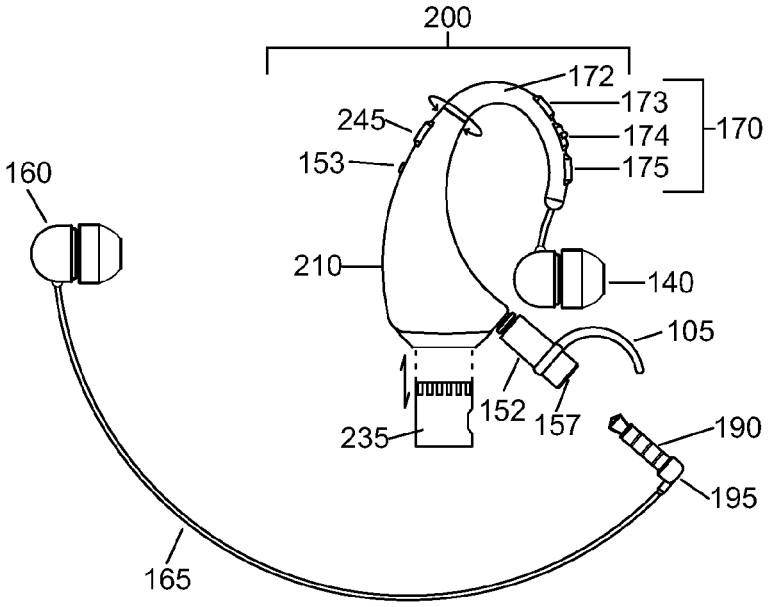
FIG. 18 illustrates a right side view of an integrated MP3 player earhook headset with headset controls, removable memory card and earbud speakers, according to an embodiment of the present invention.
Figure 18B:
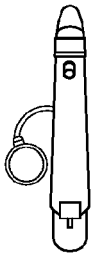
FIG. 18B illustrates a rear view of the apparatus of FIG. 18, according to an embodiment of the present invention.
Figure 18A:
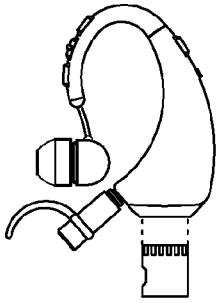
FIG. 18A illustrates a left side view of the apparatus of FIG. 18, according to an embodiment of the present invention.
Figure 18C:
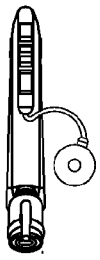
FIG. 18C illustrates a front view of the apparatus of FIG. 18, according to an embodiment of the present invention.
Figure 18D:
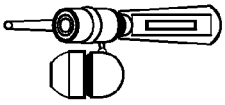
FIG. 18D illustrates a bottom view of the apparatus of FIG. 18, according to an embodiment of the present invention.
Figure 18E:
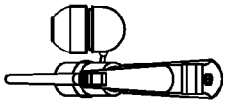
FIG. 18E illustrates a top view of the apparatus of FIG. 18, according to an embodiment of the present invention.
Figure 19:
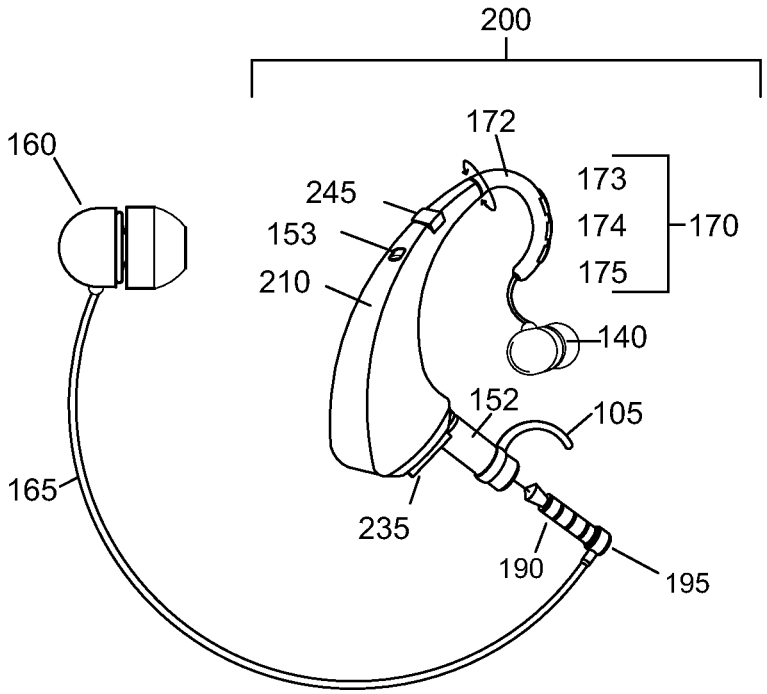
FIG. 19 illustrates a perspective view of the apparatus of FIG. 18, according to an embodiment of the present invention.

As illustrated in FIG. 18-18E and FIG. 19, an earhook player headset system according to another embodiment is provided that incorporates an integrated MP3 player circuit 220 for a removable memory card 235 and a reader 236 for the removable memory card 235 integrated in the earhook headset assembly 200. The assembly 200 comprises housing components 210 configured for a removable memory card 235. In addition to a speaker assembly 140 in the earhook body 172, a 3.5 mm audio jack 190 positioned in the assembly 200, encased by the jack cover 195, is used to provide the second channel connector stereo component when dual channel, dual ear listening by the user is deemed safe and preferred over single channel or single ear duplex sound. Connection interface jack 157 is encased by assembly cover 152 flexibly abutting the end of the housing 210. As shown, there is a flexible silicone earspring 105 that may be positioned around the assembly cover 152 and adjusted to rest comfortably and stably against the lower rear of the ear. The control switches for volume, channel change, pause is located in the earbud switch assembly 170.

FIG. 18 and FIG. 19 illustrate a side and perspective view of the apparatus providing earbud volume up control switch 173, pause switch 174, volume down control switch 175, and single/duplex single ear channel listening switch 153 and power switch 245 is provided on the assembly housing 210. The insertion of the removable memory card 235 is illustrated in FIG. 18 and as inserted and residing in the housing 210 in FIG. 19. As further shown in FIGS. 18A-18E, the earhook assembly 200 without the remote earbud assembly 160 and cable 165, from a side, rear, front, bottom and top view respectively.

Figure 20:
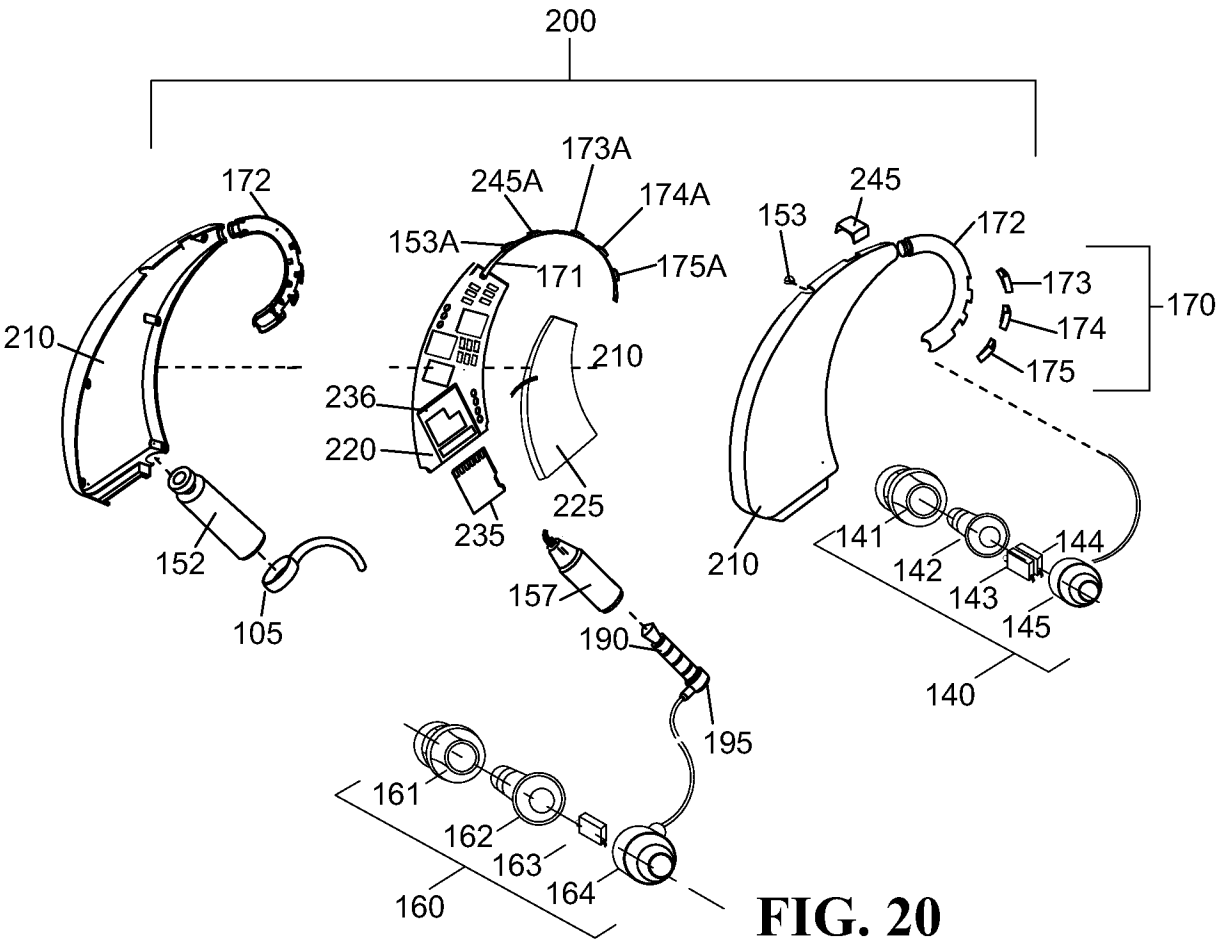
FIG. 20 illustrates an exploded assembly view of the apparatus of FIG. 18, according to an embodiment of the present invention.

As further detailed in FIG. 20, the MP3 earhook assembly 200 is illustrated in exploded view. The rechargeable power supply 225 for the system is housed within the housing components 210 of assembly 200. The jack connector 157 also functions as the connection jack interface to the host programming computer for downloading programs and restoring power to the rechargeable power supply 225. The housing components 210 may be made of a plastic or metal material and configured for a snap fit connection to each other and rotatable (threaded) connection with the rear section of the earhook switch body 172. The speaker dual mode switch 153 is further contained within the assembly 200 in which the switch 153 lays atop the surface of the housing 210 for manual control by the user. Similarly as in the apparatus of FIG. 17, the assembly 200 is illustrated in exploded view in FIG. 20 with similar components and with the additional removable memory card 235 and reader 236 configured with a removable memory card circuit board 220 within the assembly 200. The speaker assembly 140 is connected with and controlled by the earbud switch assembly 170 comprising a switch body 172 housing a switch PCB 171, an up volume switch 173 with associated up volume button 173A, a pause switch 174 with associated pause button 174A and a down volume switch 175 with associated down volume button 175A. An associated dual speaker mode button 153A and power switch button 245A are further provided on the switch PCB171.

The earhook assembly 100, 200 acts as the headset and central control hub for the MP3 audio device 20 and allows the user hands free operation of the audio device while under activity, without having to manage connecting audio wires and cables in the use of the device. The earhook style headset resides behind either ear 10 and is composed of a flexible silicone rubber earhook 110, 172, 176, having a built-in control switch interface 170, 180 for the access and control of the attached MP3 player 20, male and female 3.5 mm audio jacks, volume and channel select switches and pause button.

The headset can be worn on either ear with the user option of plugging in a short cable 165 and opposite ear speaker 160 to listen to the audio file in high quality stereo. In single ear mode, the user may choose to listen to the audio file in either single or duplex channel sound by selecting the single or dual mode position 153 on the earhook. This feature allows the user to listen to the audio files while performing other tasks. In this mode the user can carry on conversations with others, monitor surrounding ambient sounds, and perform vigorous activities while listening to the player.

The earhook directly plugs into a commercially available MP3 player 20 that contains a built-in audio source and a chargeable battery. The earhook apparatuses of FIGS. 4, 9, 12 and 15 may be used with MP3 players that have integrated external controls and others that require external headset controls such as the Apple® Shuffle. In the case of the Shuffle, the earhook directly plugs by the MP3 phone jack 155 into the audio jack and the earhook's integrated switch controls 170, 180 provide a direct interface for the control of the audio player.

In the case of MP3 players that have exterior controls, as would be implemented as in the embodiment of FIG. 4, the earhook assembly 100 directly plugs into the audio jack and converts the player from a hanging unit on the end of a long headset cord to an ear mounted, cableless apparatus.

In view of the shortcomings of the prior methods and devices, digital music players that have disadvantages such as larger size, cords that tangle and are inconvenient-to-carry under vigorous activity, the embodiment of the present invention as shown in FIG. 18, provides for an earhook headphone with earbud for playing audio files, so that users simply need to insert a storage device such as an SD memory card 235 in the reader 236 located directly on the assembly 200. For example, a card of 2 gb to 512 gb in size may be inserted into the earhook headphone assembly 200 for reading of the audio files stored in the memory card. An integrated MP3 driver circuit 220 directly plays through the integrated earhook headphone switch assembly 170 allowing users to preprogram numerous memory cards that can be played as needed. These cards can be easily distributed to others, preprogrammed and sold with audio files such as audio books, language lessons, lectures, meditation lessons, music files and any other audio files that the listener would like to hear.

Accordingly, there is provided a hanging type earhook headset as discussed in FIGS. 4, 9, 12 and 15, for integrating a digital MP3 music player 20 and the earhook headset into one unit. This MP3 hybrid according to embodiments of the present invention will operate such that a user will be able to listen to a digital music player without any peripheral auxiliary around the neck and signal cable. It is an object of the of the invention to solve the problems existing in conventional hanging type earphones in which signal cable and the necklace auxiliary may be easily entangled with each other or other external objects.

Figure 21:
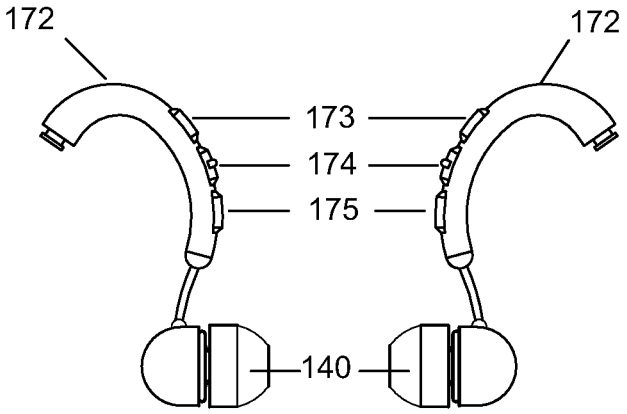
FIG. 21 illustrates a left and right view of the switch body with swivel earbud switch assembly of FIGS. 9, 15 and 18 of the apparatus, according to an embodiment of the present invention.
Figure 21A:
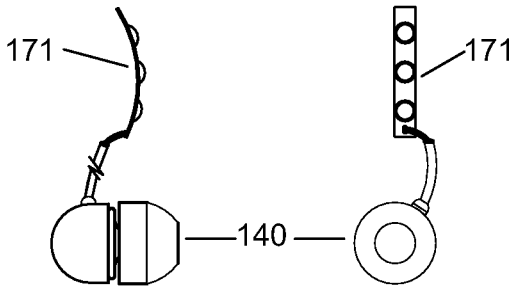
FIG. 21A illustrates a left side view and a front view showing electronic components of the swivel earbud switch assembly of FIG. 21, according to an embodiment of the present invention.
Figure 21B:
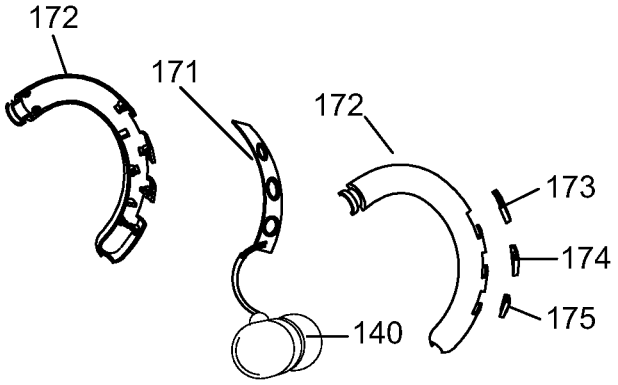
FIG. 21B illustrates an exploded perspective view of the swivel earbud switch assembly of FIG. 21, according to an embodiment of the present invention.

FIGS. 21-32 illustrate individual components which comprise the apparatus according to specific embodiments of the present invention. In particular, FIG. 21 illustrate the left and right side views of the swivel earbud speaker assembly 140 connected with the switch body 172 of the apparatus according to an embodiment of the present invention. The switch assembly 170 showing the up volume switch 173, the pause switch 174 and down volume switch 175 are conveniently located on the silicone switch body 172. In FIG. 21A, a left side view and a front view is illustrated showing electronic components of the switch PCB 171 of the swivel earbud switch assembly of FIG. 21. FIG. 21B further illustrates the exploded perspective view of the swivel earbud speaker assembly 140 of FIG. 21 and as further described with respect to FIGS. 9, 15 and 18.

Figure 22:
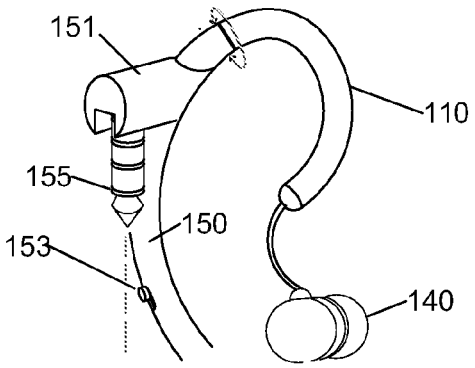
FIG. 22 illustrates a partial perspective view of the earhook with sub assembly (phone jack/electronics enclosure assembly) of FIG. 4 of the apparatus, according to an embodiment of the present invention.
Figure 22A:
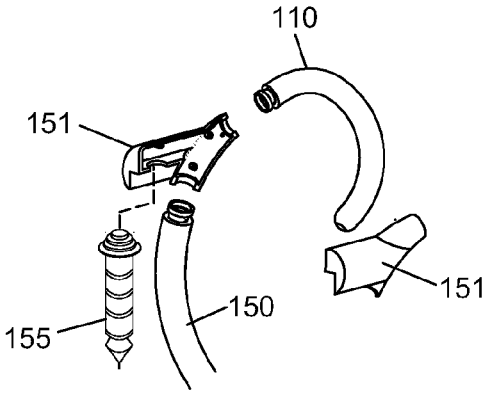
FIG. 22A illustrates a partial exploded perspective view of the earhook with sub assembly (phone jack/electronics enclosure assembly), without earbud speaker, of FIG. 22, according to an embodiment of the present invention.
Figure 22B:
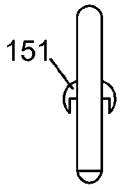
FIG. 22B illustrates a front view of the assembly of FIG. 22A, without earhook body, according to an embodiment of the present invention.
Figure 22C:
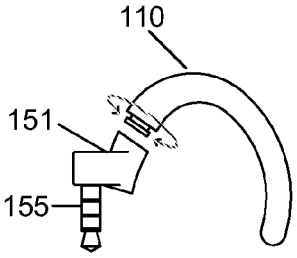
FIG. 22C illustrates a left side view of the assembly of FIG. 22A, without earhook body, according to an embodiment of the present invention.
Figure 22D:
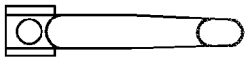
FIG. 22D illustrates a bottom view of the assembly of FIG. 22A, without earhook body, according to an embodiment of the present invention.
Figure 22E:
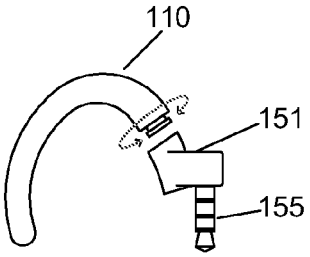
FIG. 22E illustrates a right side view of the assembly of FIG. 22A, without earhook body, according to an embodiment of the present invention.
Figure 22F:
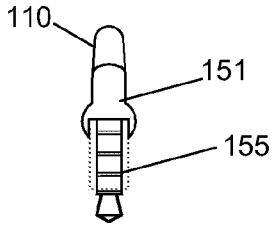
FIG. 22F illustrates a rear view of the assembly of FIG. 22A, without earhook body, according to an embodiment of the present invention.
Figure 22G:
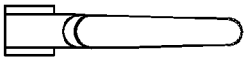
FIG. 22G illustrates a top view of the assembly of FIG. 22A, without earhook body, according to an embodiment of the present invention.

FIG. 22 illustrates a partial perspective view of the earhook 110 with subassembly 151 (phone jack/electronics enclosure assembly) of FIG. 4 of the apparatus, according to an embodiment of the present invention. FIG. 22A illustrates a partial exploded perspective view of the earhook 110 with subassembly 151, shown without the earbud speaker assembly 140. The subassembly 151 encloses the jack 155 and electronics. The earhook 110 is rotatably connected to the subassembly 151 at the upper end of the subassembly 151 and rotatably connected to the housing 150 at the lower end of the subassembly 151. FIGS. 22A-22G illustrate a front, left side, bottom, right side, rear, and top views respectively of assembly of FIG. 22, without the earhook housing body 150.

Figure 23:
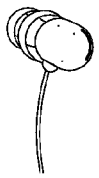
FIG. 23 illustrates a perspective view of an earbud assembly of the apparatus, according to an embodiment of the present invention.
Figure 23A:
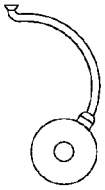
FIG. 23A illustrates a front view of the earbud assembly of FIG. 23, according to an embodiment of the present invention.
Figure 23B:
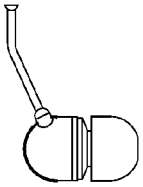
FIG. 23B illustrates a left side view of the earbud assembly of FIG. 23, according to an embodiment of the present invention.
Figure 23C:
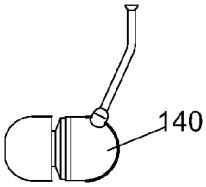
FIG. 23C illustrates a right side view of the earbud assembly of FIG. 23, according to an embodiment of the present invention.
Figure 23D:
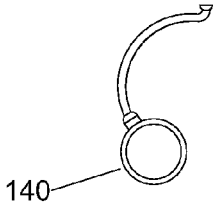
FIG. 23D illustrates a rear view of the earbud assembly of FIG. 23, according to an embodiment of the present invention.
Figure 23E:
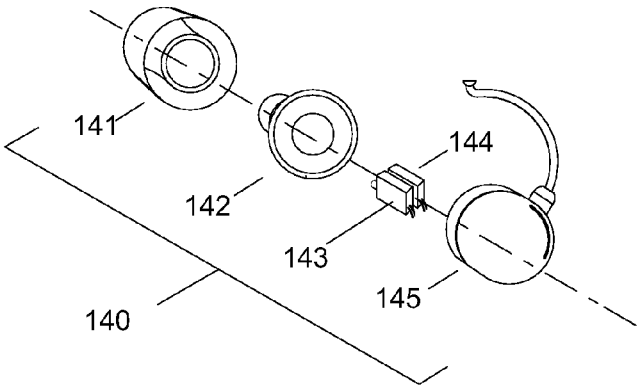
FIG. 23E illustrates an exploded perspective view of FIG. 23, according to an embodiment of the present invention.

FIG. 23 illustrates a perspective view of an earbud assembly of the apparatus, according to an embodiment. FIGS. 23A-23D illustrate the front, left side, right side, and rear views respectively of the earbud assembly 140. FIG. 24E further illustrates the exploded perspective view of FIG. 24 and as further described with respect to FIGS. 4, 9, 15 and 18. The earbud dual speaker assembly 140 comprises of an earbud cover 141, a speaker cover 142, speaker high 143 (i.e. a full range speaker) and speaker bass 144 (i.e. a mid range speaker), contained within the speaker housing 145.

Figure 24:
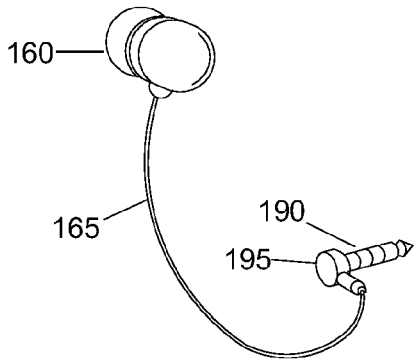
FIG. 24 illustrates a perspective view of a corresponding remote earbud assembly with jack for connection to the apparatus, according to an embodiment of the present invention.
Figure 24A:
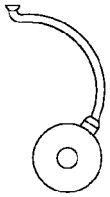
FIG. 24A illustrates a front view of the earbud assembly of FIG. 24, according to an embodiment of the present invention.
Figure 24B:
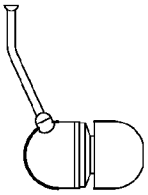
FIG. 24B illustrates a left side view of the earbud assembly of FIG. 24, according to an embodiment of the present invention.
Figure 24C:
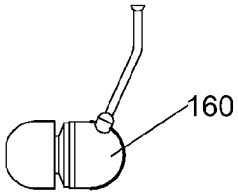
FIG. 24C illustrates a right side view of the earbud assembly of FIG. 24, according to an embodiment of the present invention.
Figure 24D:
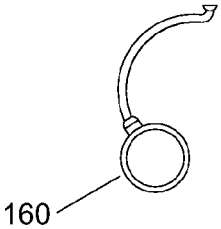
FIG. 24D illustrates a rear view of the earbud assembly of FIG. 24, according to an embodiment of the present invention.
Figure 24E:
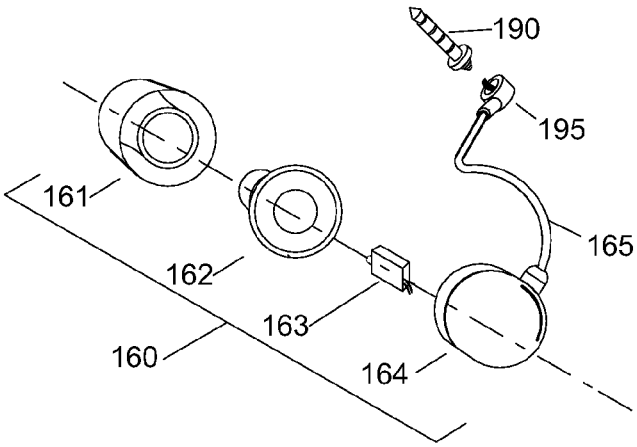
FIG. 24E illustrates an exploded perspective view of the earbud assembly of FIG. 24, according to an embodiment of the present invention.

FIG. 24 illustrates a perspective of a corresponding remote earbud assembly 160 with earbud cable 165 and an auxiliary audio jack 190 for connection to the apparatus, according to an embodiment of the present invention. FIGS. 24A-24D further illustrate the front, left side, right side, and rear views respectively of the earbud assembly 160 of FIG. 24. FIG. 24E further illustrates the exploded perspective view of FIG. 24 and as further described with respect to FIGS. 4, 9, 15 and 18. A phone jack cover 195 covers an end of the second audio phone jack 190 and connects with the earbud cable 165. Earbud assembly 160 further comprises a silicone earbud cover 161, speaker cover 162, speaker 163, and speaker enclosure 164.

FIGS. 25A-25G illustrate the side perspective, right side, rear, front, left side views respectively of the earphone switch and headset assembly 180 of the apparatus according to an embodiment of the present invention. The earphone body 183 telescopically slides up and down to fit the user as needed.

Figure 25:
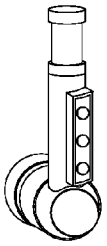
FIG. 25 illustrates a perspective view of an earphone switch and headphone assembly of the apparatus, according to an embodiment of the present invention.
Figure 25E:
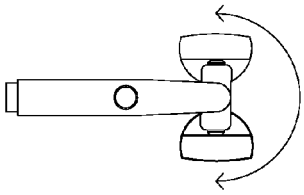
FIG. 25E illustrates a top view of the earphone switch and headphone assembly of FIG. 25, in connection with an earhook of the apparatus, according to an embodiment of the present invention.
Figure 25A:
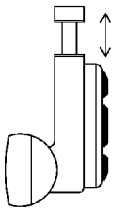
FIG. 25A illustrates a right side view of FIG. 25A, according to an embodiment of the present invention.
Figure 25B:
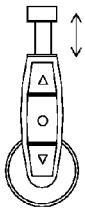
FIG. 25B illustrates a front view of FIG. 25A, according to an embodiment of the present invention.
Figure 25C:
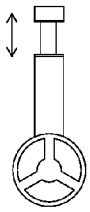
FIG. 25C illustrates a rear view of FIG. 25A, according to an embodiment of the present invention.
Figure 25D:
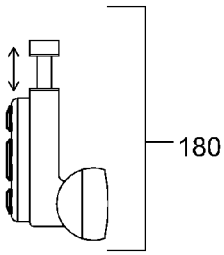
FIG. 25D illustrates a left side view of FIG. 25A, according to an embodiment of the present invention.
Figure 25F:
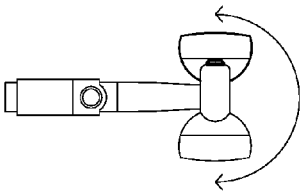
FIG. 25F illustrates a bottom view of an earphone switch and headphone assembly, in connection with an earhook of the apparatus, according to an embodiment of the present invention.
Figure 25G:
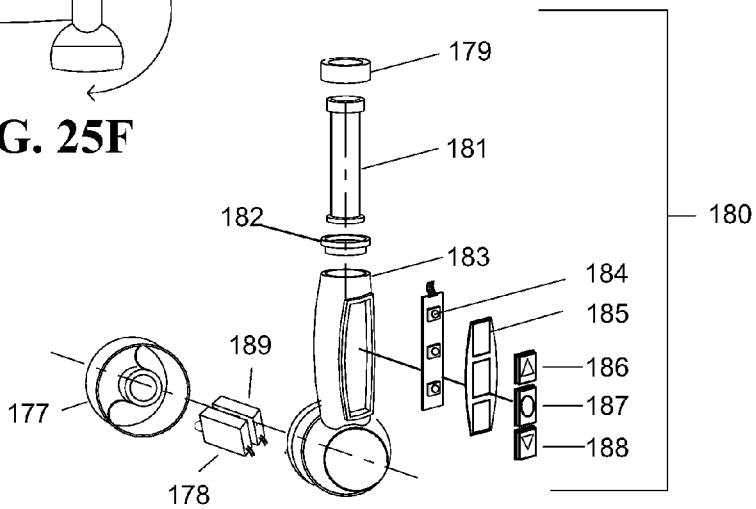
FIG. 25G illustrates an exploded perspective view of FIG. 25, according to an embodiment of the present invention.

FIGS. 25E-F illustrate the top and bottom views respectively of the earphone switch and headphone assembly of FIG. 25, in connection with an earhook of the apparatus. As further shown, the earphone body 183 rotates left or right to further accommodate the fit of the user. As shown in the exploded perspective view of FIG. 25G, the details of the headset assembly 180 comprises a headset ring clamp 179 at one end connected with a top end of the earhook 176, a telescoping shaft 181 through a slide ring 182, in connection with the earphone body 183. The earphone body 183 further comprises the control switches including the switch PCB 184, a switch face plate 185, the switch buttons for control of volume up 186, volume down 188 and power pause 187. The earphone body terminates with the earbud dual speaker assembly comprising a speaker cover 177, speaker high 189 and speaker bass 178. Further description of this configuration is described with respect to FIG. 12.

Figure 26:
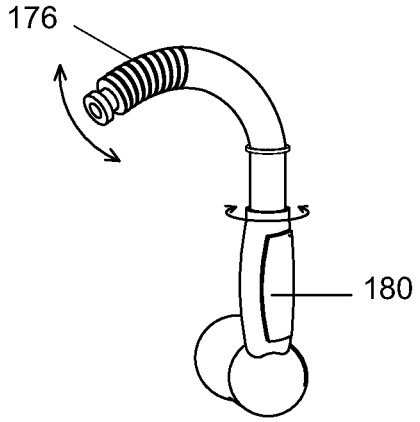
FIG. 26 illustrates a perspective view of the flexible swivel neck of the earhook with headphone assembly of the apparatus, according to an embodiment of the present invention.
Figure 26A:
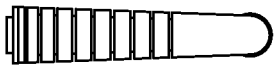
FIG. 26A illustrates a top view of the flexible swivel neck of earhook without headphone assembly of FIG. 26, according to an embodiment of the present invention.
Figure 26B:
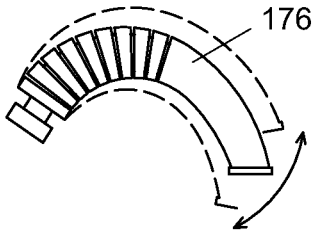
FIG. 26B illustrates a right side view of FIG. 26A, according to an embodiment of the present invention.
Figure 26C:
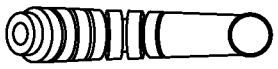
FIG. 26C illustrates a bottom view of FIG. 26A, according to an embodiment of the present invention.

FIG. 26 illustrates a perspective view of the flexible swivel neck of the earhook 176 showing the rotational orientation of the headphone assembly 180 of the apparatus. The flexible section of the silicone earhook 176 has a flexible spring compression to accommodate a user and at the same time includes a swivel movement to fit the user's ear. FIG. 26A-C illustrate the top, side and bottom views respectively of flexible earhook 176. As shown in FIG. 26B, upon connection with the earhook subassembly or housing, the flexibility of the spring compressive section of the earhook 176 in all directions allows for both comfort and stability.

Figure 27:
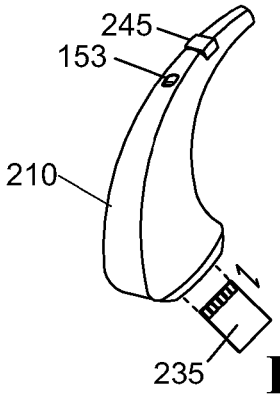
FIG. 27 illustrates a perspective view of an MP3 player headset assembly with removable memory card of the apparatus, according to an embodiment of the present invention.
Figure 27A:
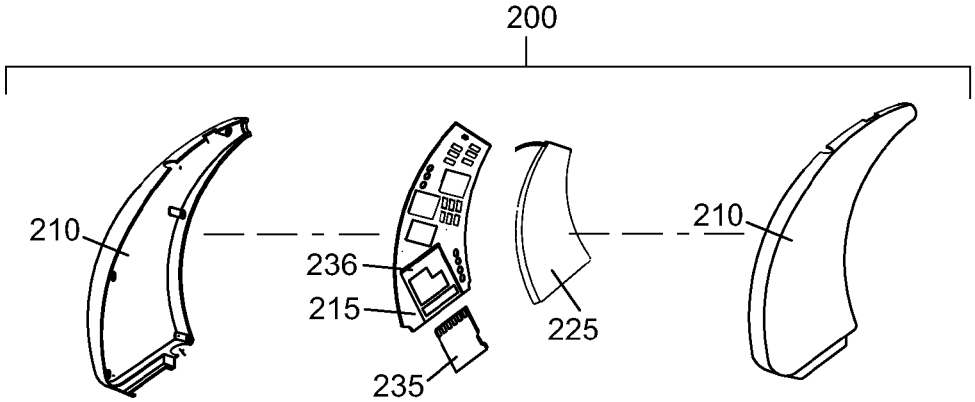
FIG. 27A illustrates an exploded perspective view of the assembly of FIG. 27, according to an embodiment of the present invention.
Figure 27C:
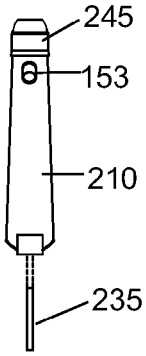
FIG. 27C illustrates a rear view of the assembly of FIG. 27, according to an embodiment of the present invention.
Figure 27D:
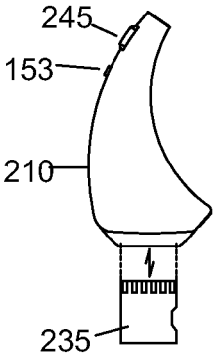
FIG. 27D illustrates a left side view of the assembly of FIG. 27, according to an embodiment of the present invention.
Figure 27E:
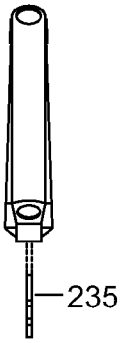
FIG. 27E illustrates a front view of the assembly of FIG. 27, according to an embodiment of the present invention.
Figure 27B:
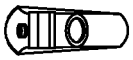
FIG. 27B illustrates a top view of the assembly of FIG. 27, according to an embodiment of the present invention.
Figure 27F:
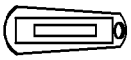
FIG. 27F illustrates a bottom view of the assembly of FIG. 27, according to an embodiment of the present invention.

FIGS. 27 and 27B-27F illustrate a perspective, top, rear, left side, front and bottom views respectively of the earhook assembly 200 of the MP3 player housing 210 configured for a removable memory card 235 of the apparatus according to an embodiment of the present invention. The housing 210 is shown without connection to the earhook body 172. The power switch 245 and speaker dual mode switch 153 are shown. FIG. 27A further illustrates the exploded perspective view of the MP3 earhook assembly 200 of FIG. 27, in which the configuration is described in detail with respect to FIG. 18. As shown, two MP3 player housing 210 sections may be snap fit connected for enclosing components comprising a removable memory card 235, reader 236, MP3 player circuit board 215, and rechargeable power supply 225.

Figure 28:
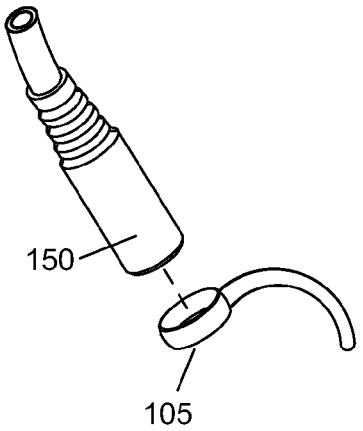
FIG. 28 illustrates an exploded partial perspective view of a flexible connector housing with adjustable earspring for an earhook adaptor headset of the apparatus, according to an embodiment of the present invention.
Figure 28A:
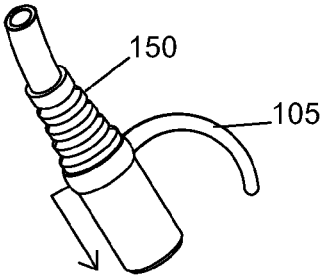
FIG. 28A illustrates a perspective view of the flexible connector housing with adjustable earspring of FIG. 28, in retracted position, according to an embodiment of the present invention.
Figure 28B:
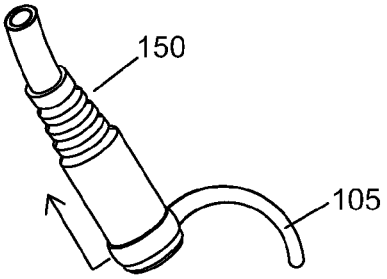
FIG. 28B illustrates a perspective view of the flexible the flexible connector housing with adjustable earspring of FIG. 28, in extended position, according to an embodiment of the present invention.
Figure 28C:
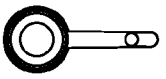
FIG. 28C illustrates a bottom view of FIG. 28A, according to an embodiment of the present invention.
Figure 28D:
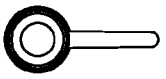
FIG. 28D illustrates a top view of FIG. 28A, according to an embodiment of the present invention.
Figure 28E:
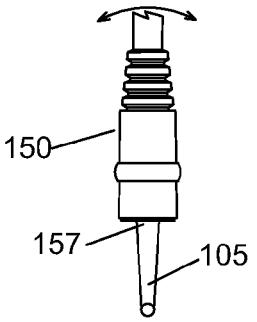
FIG. 28E illustrates a rear view of FIG. 28A, in a partially extended position, according to an embodiment of the present invention.
Figure 28F:
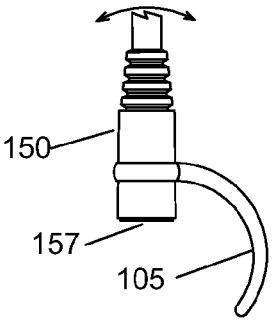
FIG. 28F illustrates a right side view of FIG. 28E, according to an embodiment of the present invention.
Figure 28G:
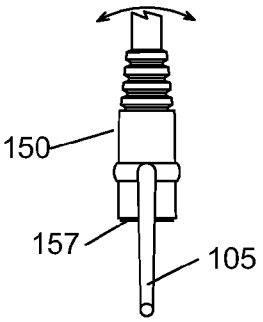
FIG. 28G illustrates a front view of FIG. 28E, according to an embodiment of the present invention.

In embodiments according to the present invention, the earhook 110, 172, 176 of the headset is configured with a flexible spring tail design that aides in the stability of the headset about the ear during activity. In FIGS. 28 and 28C-28E, there is shown an exploded perspective, bottom, top, front, left side, and right side view respectively of an embodiment of the soft earspring 105 surrounding the housing 150 of the apparatus are illustrated. FIG. 28A and FIG. 28B illustrate a perspective view of the flexible connector housing 150 with adjustable earspring 105 of FIG. 28, in retracted position and extended position respectively. The earspring 105 comprises an arc-like tail profile originating from a ring aperture and terminating to an end point such that the earspring 105 rests comfortably and stably against the lower rear of the ear. In use, the soft flexible silicone of the softspring 105 puts pressure to the back side of the ear's lobule and anti-tragus, thus locking it into place from moving up or down along the back of the ear's anti-helic. The variable adjustability of the softspring 105 being retracted or extended allows for tightening and loosening the earhook housing 150 on the back side of the ear as needed. The housing 150 as shown, further illustrates the flexibility of the compressive and springy section of the housing 150 allowing for full adjustability in movement.

Figure 29:
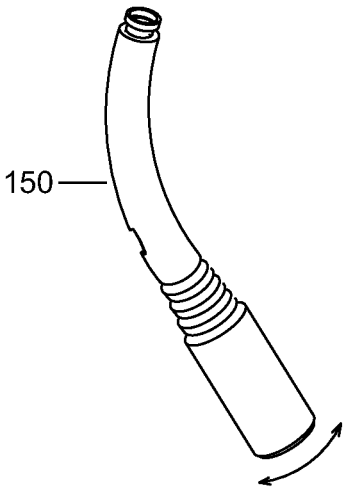
FIG. 29 illustrates a perspective view of the flexible earhook housing of the apparatus for an earhook adaptor headset, according to an embodiment of the present invention.
Figure 29A:
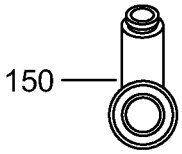
FIG. 29A illustrates a bottom view of FIG. 29, according to an embodiment of the present invention.
Figure 29B:
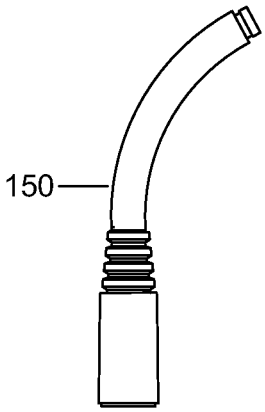
FIG. 29B illustrates a right side view of FIG. 29, according to an embodiment of the present invention.

FIGS. 29, 29A and 29B illustrate a perspective, bottom and right side view of the flexible earhook housing 150 of the apparatus for an earhook adaptor headset, according to an embodiment. A shown, the flexible silicone earhook housing 150 supports the addition of the springtail 105 and further provides for an overall flexibility of the total housing body 150 itself.

Figure 30:
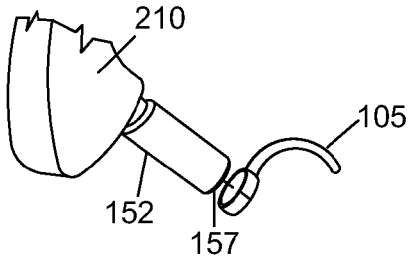
FIG. 30 illustrates a partial exploded perspective view of the flexible audio jack interface assembly cover/power connector housing with adjustable earspring for an integrated audio player, according to an embodiment of the present invention.
Figure 30A:
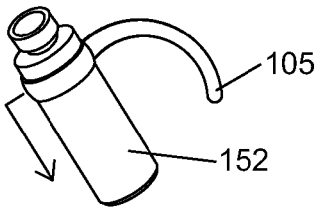
FIG. 30A illustrates a perspective view of the flexible audio jack interface assembly cover of FIG. 30, with earspring in retracted position, according to an embodiment of the present invention.
Figure 30B:
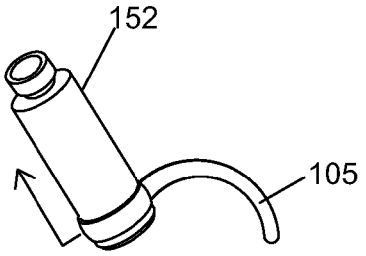
FIG. 30B illustrates a perspective view of the flexible audio jack interface assembly cover of FIG. 30, with earspring in extended position, according to an embodiment of the present invention.
Figure 30C:
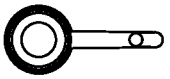
FIG. 30C illustrates a bottom view of FIG. 30A, according to an embodiment of the present invention.
Figure 30D:
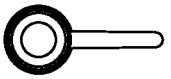
FIG. 30D illustrates a top view of FIG. 30A, according to an embodiment of the present invention.
Figure 30E:
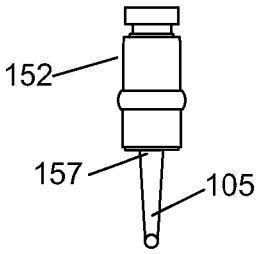
FIG. 30E illustrates a rear view of FIG. 30A, in a partially extended position, according to an embodiment of the present invention.
Figure 30F:
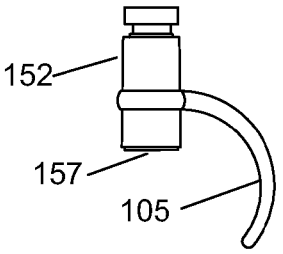
FIG. 30F illustrates a right side view of FIG. 30E, according to an embodiment of the present invention.
Figure 30G:
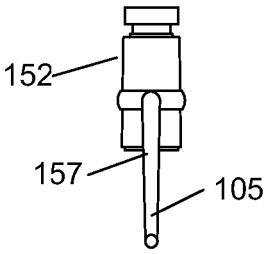
FIG. 30G illustrates a front view of FIG. 30E, according to an embodiment of the present invention.

FIG. 30, illustrates a partial exploded perspective view of the flexible audio jack interface assembly cover/power connector housing 152 with adjustable earspring 105 for an integrated audio player, such as the MP3 player earhook assembly 200, according to an embodiment. FIGS. 30A-30B illustrate a perspective view of the flexible audio jack interface assembly cover 152 with earspring 105 in retracted position and in extended position respectively. In FIGS. 30C-30G, the bottom, top, rear, side and front views of the spring tail/phone jack assembly cover 152 with earspring 105 of the apparatus of FIG. 30A are illustrated. The earspring 105 is adjustable for sliding along the vertical axis of the assembly cover 152 which houses the interface connection 157 within. The springtail/earspring 105 comprises an aperture on the rear of the earspring 105 for connection to the corresponding jack assembly cover 152 protruding from the MP3 player housing 205/210. The aperture is in the form of a ring to allow the protruding jack assembly cover 152 to be inserted into the ring for connection. The silicone material of the components facilitates the gripping character of the earhook and secures the earspring 105 around the assembly cover 152 such that it is adjustable with some manipulation yet secured in position by the material.

Figure 31:
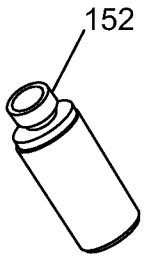
FIG. 31 illustrates a perspective view of the audio jack assembly cover, according to an embodiment of the present invention.
Figure 31A:
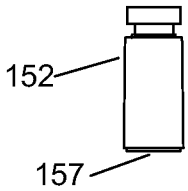
FIG. 31A illustrates a side view of the audio jack assembly cover, according to an embodiment of the present invention.
Figure 31B:
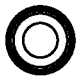
FIG. 31B illustrates a bottom view of FIG. 31A, according to an embodiment of the present invention.
Figure 31C:
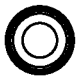
FIG. 31C illustrates a top view of FIG. 31A, according to an embodiment of the present invention.

FIGS. 31-31C, illustrate a perspective, side, top and bottom view of the audio jack assembly cover 152 respectively, according to an embodiment of the present invention. The connection interface jack 157 is housed within the assembly cover 152.

Figure 32:
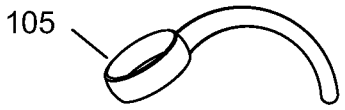
FIG. 32 illustrates a perspective view of a flexible and adjustable silicon earspring of the apparatus, according to an embodiment of the present invention.
Figure 32A:
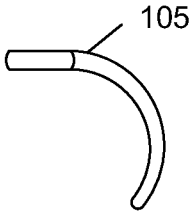
FIG. 32A illustrates a front view of FIG. 32, according to an embodiment of the present invention.
Figure 32B:
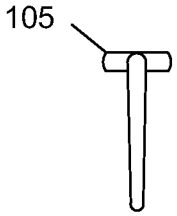
FIG. 32B illustrates a side view of FIG. 32, according to an embodiment of the present invention.
Figure 32C:
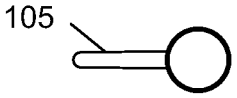
FIG. 32C illustrates a top view of FIG. 32, according to an embodiment of the present invention.
Figure 32D:
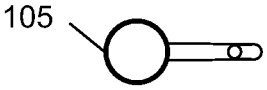

FIGS. 32-32D illustrate a perspective, front, side, top and bottom view of the flexible earspring 105 respectively, according to an embodiment of the present invention. The earspring 105 may be made of flexible and soft silicone material as an integral design of the structural elements of the earhook headset and serves to function as the gripping and stabilizing element of the earhook headset in securing the unit behind or near the ear. Other similar materials to silicone may be used as the material for the springtail in providing a soft and gripping structure.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

I claim:

1. An audio headset adaptor apparatus comprising:

a portable media player device having a power source and integrated control function buttons;

an earhook assembly configured to operably connect to the portable media player device through a first interface jack connector, the earhook assembly comprising a flexible gripping earhook mountable behind an ear, the earhook having a top end and terminating at a bottom end at about behind an earlobe, the bottom end adjustable behind the ear;

a first earphone portion comprising a first earbud with dual speakers and operably integrated with the earhook through a rotatable connection with a defined length of cable protruding from the top end of the earhook;

an auxiliary jack socket integrated with the earhook behind the ear; and control circuitry, housed within the earhook assembly, for controlling a set of integrated control functions manipulated by one or more switches located on the earhook assembly;

wherein a first switch controls a single or dual channel audio in the first earphone portion, such that the first switch in a first position activates a single speaker of the first earphone portion to play a first channel of an audio signal of the player device and the first switch in a second position activates the dual speakers in the first earphone portion to play a first channel and second channel of the audio signal of the player device respectively.

2. The audio headset adaptor apparatus according to claim 1, further comprising a second earphone portion having a second earbud with a speaker for providing audio to the other ear, operably connected to a second audio jack connector through a defined length of cable and for connection with the auxiliary jack socket on the earhook assembly.

3. The audio headset adaptor apparatus according to claim 1, wherein the media player device is a discrete personal MP3 player.

4. The audio headset adaptor apparatus according to claim 1, wherein the earhook assembly further comprises a housing portion extending from a rear of the earhook assembly for housing the control circuitry.

5. The audio headset adaptor apparatus according to claim 1, wherein the auxiliary jack socket comprises a wired data connection port configured for downloading media files to a memory of the media player device from an external device or configured for charging the power source of the media player device.

6. The audio headset adaptor apparatus according to claim 1, wherein the earhook assembly is configured to operably connect to the media player device through a wired data connection port.

7. The audio headset adaptor apparatus according to claim 5, wherein the wired data connection port is a USB port.

8. The audio headset adaptor apparatus according to claim 1, wherein the earhook comprises a soft silicone material and includes a spring tail end configured to compress upon the rear of the ear.

9. An audio headset adaptor apparatus comprising:

a portable media player device having a memory and a power source;

an earhook assembly configured to operably connect to the media player device through a first interface connector, the earhook assembly comprising a flexible gripping earhook mountable behind an ear, the earhook having a top end and terminating at a bottom end at about behind the earlobe, the bottom end having an adjustably extendable and retractable compressive earspring;

a plurality of button controller switches positioned to extend from the top end of the earhook for controlling functions of the media player device;

a first earphone portion operably integrated with the earhook, extending from the plurality of button controller switches from the top end of the earhook, the first earphone portion comprising a first earbud with dual speakers;

a connection port integrated with the earhook behind the ear;

a second earphone portion having a second earbud with a speaker for providing audio to the other ear, operably connected to a second interface connector through a defined length of cable and for connection with the connection port on the earhook assembly; and control circuitry for controlling a plurality of control functions, including control functions of the player device activated by the plurality of button controller switches;

wherein a first switch controls a single or dual channel audio in the first earphone portion, such that the first switch in a first position activates a single speaker of the first earphone portion to play a first channel of an audio signal of the player device and the first switch in a second position activates the dual speakers in the first earphone portion to play a first channel and second channel of the audio signal of the player device respectively.

10. The audio headset adaptor apparatus according to claim 9, wherein the first earbud is connected to the earhook through a defined length of cable protruding from the plurality of button controller switches from the top end of the earhook in front of the ear.

11. The audio headset adaptor apparatus according to claim 9, wherein the first earbud is telescopically integrated with the plurality of button controller switches to the top end of the earhook.

12. The audio headset adaptor apparatus according to claim 9, wherein the plurality of control functions include, power, volume up, volume down, play, pause and track selection.

13. The audio headset adaptor apparatus according to claim 9, wherein the media player device is a discrete personal MP3 player.

14. The audio headset adaptor apparatus according to claim 9, wherein the connection port on the earhook assembly comprises a wired data connection port configured for downloading media files to the memory of the media player device from an external device or configured for charging the power source of the media player device.

15. The audio headset adaptor apparatus according to claim 14, wherein the wired data connection port is a USB port.

16. An audio headset system comprising:

a component housing for housing a media player controller, a micro flash memory, and a battery power supply;

a flexible gripping earhook assembly mountable behind an ear and integrated with the component housing such that the housing resides behind the ear, the earhook assembly having a top end and terminating at a bottom end at about behind the earlobe, wherein the bottom end having an adjustable earspring configured to contract inward toward the housing or extend outward to lengthen the earspring;

a first earphone portion comprising a first earbud with dual speakers and operably integrated with the earhook assembly through a pivot connection with a defined length of cable protruding from the top end of the earhook assembly;

an interface jack socket integrated with the earhook assembly and housed within the component housing;

a plurality of control switches;

control circuitry for controlling a set of integrated control functions manipulated by the plurality of control switches;

wherein a first switch controls a single or dual channel audio in the first earphone portion, such that the first switch in a first position activates a single speaker of the first earphone portion to play a first channel of an audio signal of the media player and the first switch in a second position activates the dual speakers in the first earphone portion to play a first channel and second channel of the audio signal of the media player respectively.

17. The audio headset system according to claim 16, further comprising a second earphone portion having a second earbud with a remote speaker for providing audio to the other ear, operably connected to an audio jack connector through a defined length of cable and for connection with the interface jack socket.

18. The audio headset system according to claim 16, wherein the flash memory is a removable flash memory chip; and the component housing further comprises a removable memory card reader accessible from the rear of the component housing.

19. The audio headset system according to claim 16, wherein the interface jack socket comprises a wired data connection port on the component housing, configured for downloading media files to the flash memory from an external device or configured for charging the battery power supply.

20. The audio headset system according to claim 19, further comprising a microphone and a recording device for recording audio files to the flash memory, integrated into the component housing; wherein the wired data connection port is configured for downloading the audio files to an external device.

* * * * *